US011612935B2

(12) United States Patent
Holloway et al.

(10) Patent No.: US 11,612,935 B2
(45) Date of Patent: Mar. 28, 2023

(54) METALLIC COMPOUNDS AND METALLIC MATRIX COMPOSITES MADE USING COMPRESSION ACTIVATED SYNTHESIS

(71) Applicant: Parker Lodge Holdings LLC, Elmhurst, IL (US)

(72) Inventors: Scott Richard Holloway, Calgary (CA); Richard Manley, Calgary (CA)

(73) Assignee: PARKER LODGE HOLDINGS LLC, Elmhurst, IL (US)

( * ) Notice: Subject to any disclaimer, the term of this patent is extended or adjusted under 35 U.S.C. 154(b) by 534 days.

(21) Appl. No.: 16/098,527

(22) PCT Filed: May 4, 2017

(86) PCT No.: PCT/CA2017/050540
§ 371 (c)(1),
(2) Date: Nov. 2, 2018

(87) PCT Pub. No.: WO2017/190243
PCT Pub. Date: Nov. 9, 2017

(65) Prior Publication Data

US 2019/0151950 A1 May 23, 2019

Related U.S. Application Data

(60) Provisional application No. 62/331,507, filed on May 4, 2016.

(51) Int. Cl.

| | |
|---|---|
| ***B22F 3/23*** | (2006.01) |
| ***C22C 1/05*** | (2006.01) |
| ***B22F 1/05*** | (2022.01) |

(52) U.S. Cl.
CPC ..... *B22F 3/23* (2013.01); *B22F 1/05* (2022.01); *C22C 1/058* (2013.01);
(Continued)

(58) Field of Classification Search
CPC ..... B22F 3/23; C22C 1/058
See application file for complete search history.

(56) References Cited

U.S. PATENT DOCUMENTS 3,353,954 A 11/1967 Williams
4,605,633 A * 8/1986 DeAngelis ..... C04B 35/5156 501/87

(Continued)

FOREIGN PATENT DOCUMENTS

WO 2012/108980 A1 8/2012
WO 2017/190243 A1 11/2017

(Continued)

OTHER PUBLICATIONS

Horvitz D., et al.; "In situ processing of dense Al2O3—Ti aluminide interpenetrating phase composites", J. of the European Ceramic Society, 22, 2002, 947-954 (Year: 2002).*

(Continued)

*Primary Examiner* — Kevin E Yoon
*Assistant Examiner* — Austin Pollock

(57) ABSTRACT

Articles are manufactured using self-propagating high-temperature synthesis (SHS) reactions. Particulates including reactants can be blended to form a particulate blend. The particulate blend can be preformed. The preform article can be heated to a pre-heat temperature being below an auto-activation temperature and above a minimum compression activated synthesis temperature. Compressive stress can be exerted on the preform article at the pre-heat temperature to initiate the SHS reaction between the reactants and thereby form a product metallic compound. At approximately peak temperature, a flow stress of the product metallic compound can be exceeded to substantially reduce porosity and thereby form a shaped substantially dense article.

20 Claims, 8 Drawing Sheets

(52) U.S. Cl.
CPC ..... *B22F 2301/205* (2013.01); *B22F 2302/253* (2013.01); *B22F 2304/10* (2013.01); *B22F 2998/10* (2013.01)

(56) References Cited

U.S. PATENT DOCUMENTS

| | | | | | |
|---|---|---|---|---|---|
| 4,655,830 | A | * | 4/1987 | Akashi | C04B 35/651 264/DIG. 36 |
| 4,751,048 | A | * | 6/1988 | Christodoulou | C22C 49/00 420/129 |
| 4,909,842 | A | | 3/1990 | Dunmead et al. | |
| 5,114,645 | A | * | 5/1992 | Niiler | C04B 35/651 264/80 |
| 5,382,405 | A | * | 1/1995 | Lowrance, II | B22F 3/23 264/434 |
| 5,794,113 | A | * | 8/1998 | Munir | B22F 3/23 419/45 |
| 5,837,632 | A | | 11/1998 | Sekhar et al. | |
| 2006/0032558 | A1 | | 2/2006 | Holloway | |
| 2013/0180758 | A1 | | 7/2013 | Holloway | |

FOREIGN PATENT DOCUMENTS

| | | | |
|---|---|---|---|
| WO | 2017/190245 | A1 | 11/2017 |
| WO | 2017/190246 | A1 | 11/2017 |
| WO | 2017/190247 | A1 | 11/2017 |

OTHER PUBLICATIONS

Paransky E., et al.; "Pressure-Assisted Reactive Synthesis of Titanium Aluminides from Dense 50Al—50Ti Elemental Powder Blends"; Metallurgical and Material Transactions, vol. 27a, 1996 (Year: 1996).*

Travitzky N., et al; "Alumina-Ti aluminide interpenetrating composites: microstructure and mechanical properties", Material Letters, 57, 2003, p. 3422-3426 (Year: 2003).*

Horvitz D., "Pressure-assisted SHS synthesis of MgAl2O4—TiAl in situ composites with interpenetrating networks", Acta Materialia, 50, 2002, 1961-1971 (Year: 2002).*

Gutmanas E., et al; "Dense High-Temperature Ceramics by Thermal Explosion Under Pressure", J. of European Ceramics, 19, 1999, p. 2381-2393 (Year: 1999).*

Gotman I, et al.; "Dense in situ TiB2—TiN and TiB2—TiC ceramic matrix composite"; Materials Science & Engineering; 1998, p. 127-137 (Year: 1998).*

Hanus E., et al.; "Thermodynamic Effects in the Compression of Solids", J. of Pharmaceuticals; 1968, vol. 57, Issue 4 (Year: 1968).*

International Search Report and Written Opinion dated Aug. 9, 2017 in respect of International Application No. PCT/CA2017/050540.

International Preliminary Report on Patentability dated Nov. 6, 2018 in respect of International Application No. PCT/CA2017/050540.

Lima et al., "Metal Matrix Composites from Self-Propagating Synthesis and Hot Pressing", Microscopy and Analysis, Sep. 2001, pp. 29-31.

* cited by examiner

METALLIC COMPOUNDS AND METALLIC MATRIX COMPOSITES MADE USING COMPRESSION ACTIVATED SYNTHESIS

CROSS-REFERENCE TO RELATED APPLICATIONS

This is a national stage application of International Application No. PCT/CA2017/050540 filed May 4, 2017, which claims priority to U.S. Patent Application No. 62/331,507 filed May 4, 2016, and the entire contents of each are hereby incorporated herein by reference.

FIELD

The present disclosure relates generally to self-propagating high-temperature synthesis reactions, and notably to methods of making metallic compounds and matrix composites using self-propagating high-temperature synthesis reactions.

INTRODUCTION

The following paragraphs are not an admission that anything discussed in them is prior art or part of the knowledge of persons skilled in the art.

A self-propagating high-temperature synthesis reaction (or "SHS" reaction) can be said to be an exothermic chemical reaction having a rate of reaction and subsequent rate of heating which is sufficient to cause the chemical reaction to self-propagate. Techniques to perform SHS reactions can be used to make metallic compounds and metallic matrix composite compounds, using for example, blended powder reactants as initial reactant materials. The resultant reaction products frequently exhibit unique material characteristics deemed useful for science and engineering applications. Thus, methods and techniques for the performance of SHS reactions are deemed highly desirable.

In its simplest form, an SHS reaction can be said to occur according to the following chemical formula:

$$A+B \longrightarrow AB-\Delta H$$

where "A" and "B" are elements which combine to form chemical compound "AB", and the term ΔH is the heat of reaction, which can be calculated as follows:

$$\Delta H=\Sigma\Delta_f H_{PRODUCTS}-\Sigma\Delta_f H_{REACTANTS},$$

where $\Delta_f H$ is the enthalpy of formation. For the chemical formula above, the value of ΔH can be calculated as:

$$\Delta H=\Delta_f H_{AB}-\Delta_f H_A-\Delta_f H_B,$$

and because the enthalpy of formation of elements is defined to be zero, this equation can be reduced to:

$$\Delta H=\Delta_f H_{AB}.$$

For exothermic reactions the value of ΔH is defined as less than zero, and is equal to the amount of heat energy per mole of reactant released as a result of the reaction.

In order to understand whether or not a driving force exists for the reaction, it is generally necessary to evaluate the change in Gibbs free energy, which can be said to related to the heat of the reaction, temperature and change in entropy by the equation:

$$\Delta G=\Delta H-T\Delta S.$$

In order for the driving force to exist, the value of ΔG must be less than zero, and in such cases the reaction can be said to be "spontaneous". The change in Gibbs free energy for the reaction can be calculated as:

$$\Delta G=\Sigma\Delta_f G_{PRODUCTS}-\Sigma\Delta_f G_{REACTANTS},$$

where $\Delta_f G$ is the Gibbs free energy of formation for the compounds in the reaction. For the reaction above, the change in Gibbs free energy can be calculated as:

$$\Delta_f G=\Delta_f G_{AB},$$

where "$\Delta_f G_{AB}$" is the Gibbs free energy of formation for the chemical compound "AB".

Chemical reactions are the result of collisions between the constituent atoms of the reactants, and therefore it is generally assumed true that a certain amount of energy must be put into the system in order to cause a sufficient number of collisions with sufficient energy to break the bonds between the reactant atoms. This is true even if the ΔG is less than zero, and the reaction is considered to be spontaneous. The amount of energy necessary to cause the reaction to proceed is referred to as the activation energy ($E_a$), and the relationship between $E_a$, ΔH and the progression of the reaction is illustrated in FIG. 1.

The reaction rate (v), which is commonly thought of in terms of the number of moles of reactant consumed per unit time can be expressed as follows:

$$v=-\frac{d[A]}{dt}-\frac{d[B]}{dt},$$

where the terms "[A]" and "[B]" represent the concentration of the reactants A and B. For the simple reaction above, which is second order overall and first order in each reactant, the reaction rate can be calculated as:

$$v=k[A][B].$$

The term "k" is known as the rate constant, which also has units of moles per unit time. The Arrhenius equation, which was originally derived empirically, quantifies the rate constant for ideal gas reactions as a function of the activation energy ($E_a$) and temperature (T) and can be expressed as follows:

$$k=F\cdot e^{-Ea/(RT)},$$

where the pre-exponential factor "F" is the atomic collision frequency, and "R" is the universal gas constant. The exponential term is the probability that the given collision will in fact result in a reaction.

Similarly, transition state theory provides the means to calculate the rate constant (k) as a function of temperature and the Gibbs energy of activation ($\Delta G^{\ddagger}$) using the Eyring equation, which can be expressed as follow:

$$k=\frac{k_B T}{h}\cdot e^{\Delta G^{*}/(RT)},$$

where $K_B$ is Boltzmann's constant and "h" is Planck's constant. The Gibbs energy of activation is the standard Gibbs energy difference between the transition state of a reaction and the ground state of the reactants, and is therefore analogous to the activation energy (FIG. 2). When evaluating the SHS reactions and relating thermodynamics to reaction kinetics, it is often convenient to do so using transition state theory and the Eyring equation.

In order to trigger a self-propagating exothermic reaction, it is generally necessary to apply heat energy in excess of the activation energy to a sufficient portion of the reactant material, such that the heat of the resulting reaction in turn provides sufficient energy to exceed the activation energy of neighboring unreacted material. As a result, the neighboring material can then react, and this chain reaction can continue to propagate until all of the reactant material is consumed. Because the heat of reaction is necessary to maintain SHS, consideration must be given to the heat lost to the surrounding environment. In order to minimize heat loss, all reactant material can be heated uniformly until multiple points of activation occur simultaneously and then quickly propagate throughout. This method of SHS is commonly referred to as "thermal explosion mode" (FIG. 3).

In summary, SHS reactions can be characterized as exothermic (i.e. having a $\Delta H<0$) and spontaneous (i.e. having a $\Delta G<0$).

A variety of classes of materials can be produced using techniques for the performance of SHS reactions. Thus, for example, metallic compounds can be made, where the product is formed from two or more metallic elements:

$$A+B \longrightarrow AB-\Delta H$$

where "A" and "B" are metallic elements and "AB" is the metallic compound. The resulting heat of reaction can be given by:

$$\Delta H=\Delta_f H_{AB},$$

and the change in Gibbs free energy can be given by:

$$\Delta G=\Delta_f G_{AB}.$$

This type of reaction can further be generalized to include additional reactant elements described in general formula as:

$$A+B+\{C\ldots\} \longrightarrow AB\{C\ldots\}-\Delta H$$

where the term "AB{C . . . }" represents any possible single phase composition comprising reactant elements, such as, for example, "ABC", "AB+AC", or "AC+BC". For this generalized form the heat reaction can be given by:

$$\Delta H=\Delta_f H_{AB\{C\ldots\}},$$

with the change in Gibbs free energy can be given by:

$$\Delta G=\Delta_f G_{AB\{C\ldots\}}.$$

Another class of materials that can be made using SHS techniques is metallic matrix composite materials with one or more mechanically blended reinforcement phases. The manufacture of this class of materials generally involves a co-blending of an additional material with the reactants, however the additional material does not directly participate in the SHS reaction. This type of reaction can in general terms be described as:

$$A+B+X \longrightarrow AB+X-\Delta H,$$

where X represents the compound that acts as the reinforcement phase in the finished metallic matrix composite having undergone no chemical change in the conduct of the SHS reaction. This type of reaction can be further generalized to include additional reactant elements, described in general form as:

$$A+B+\{C\ldots\}+\{X\ldots\} \longrightarrow AB\{C\ldots\}+\{X\ldots\}-\Delta H$$

where the term "{X . . . } represents one or more reinforcement compounds. For this generalized form the reaction can be given by:

$$\Delta H=\Delta_f H_{AB\{C\ldots\}},$$

and the change in Gibbs free energy can be given by:

$$\Delta G=\Delta_f G_{AB\{C\ldots\}}.$$

While the compounds "{X . . . . }" are not considered with regard to whether the reaction is exothermic or spontaneous, it is important to consider other thermal and mechanical effects of such additives. For example, any compound "X" will absorb heat from the reaction as a function of the compound's thermal conductivity and heat capacity ($C_p$), and in that sense it is analogous to heat lost in the environment. Such heat is temporarily unavailable with regard to propagating the reaction, although it is over time transferred back to the reaction product, and ultimately out to the environment. In this sense, the thermal effect of additives "{X . . . . }" represents a transient heat transfer relative to the reaction, or in other words, a time delay in terms of making the heat reaction available for self-propagation.

Another example class of materials that can be produced using SHS is "in situ" metallic matrix composites. These are composites comprising a reinforcement phase, wherein the reinforcement phase directly participates in the SHS reaction. Two primary reactions can be distinguished. The first reaction can be described in its basic form as:

$$A+BY \longrightarrow B+AY-\Delta H,$$

where "A" and "B" are metallic elements. Y is a non-metallic element, including, but not limited to boron, carbon, nitrogen or oxygen. "BY" and "AY" are chemical compounds containing at least one metallic element and at least one non-metallic element and "AY" is the in situ formed reinforcement phase. This reaction is characterized by the element "B" appearing in its pure elemental form, which does not react with chemical compound "A". The resulting heat of the reaction ($\Delta H$) can be given by:

$$\Delta H=\Delta_f H_{AY}-\Delta_f H_{BY},$$

and the change in Gibbs free energy ($\Delta G$) can be given by:

$$\Delta G=\Delta_f G_{AY}-\Delta_f G_{BY}.$$

This type of reaction can further be generalized to include additional reactant compounds, described in general as:

$$A+BY+\{CY\ldots\} \longrightarrow B\{C\ldots\}+AY-\Delta H,$$

where the reactant term {CY . . . } represents any number of additional compounds containing at least one metallic element and at least one non-metallic element, and the product term B{CY . . . } represents any possible combination of metallic phases, such as "BC", "B+C", etc. For this generalized form the heat reaction van be given by:

$$\Delta H=\Delta_f H_{B\{C\ldots\}}+\Delta_f H_{AY}-\Delta_f H_{BY}-\Delta_f H_{\{CY\ldots\}},$$

with the change in Gibbs free energy ($\Delta G$) given by:

$$\Delta G=\Delta_f G_{B\{C\ldots\}}+\Delta_f G_{AY}-\Delta_f G_{BY}-\Delta_f G_{\{CY\ldots\}}.$$

The second reaction of the two types of primary reactions is characterized by the element "B" forming a chemical compound "AB" with reactant "A", which can be described in its basic form as:

$$A+BY \longrightarrow AB+AY-\Delta H$$

and the resulting heat ($\Delta H$) of the reaction can be given by:

$$\Delta H=\Delta_f H_{AB}+\Delta_f H_{AY}-\Delta_f H_{BY},$$

and the change in Gibbs free energy ($\Delta G$) can be given by:

$$\Delta G=\Delta_f G_{AB}+\Delta_f G_{AY}-\Delta_f G_{BY}.$$

Similarly, this type of reaction can be further generalized to include additional reactant compounds, and can be described in general form as follows:

$$A+BY+\{ACY\ldots\} \longrightarrow AB\{C\ldots\}+AY-\Delta H,$$

and the resulting heat of reaction (ΔH) can be given by:

$$\Delta H=\Delta_f H_{AB\{C\ldots\}}+\Delta_f H_{AY}-\Delta_f H_{BY}-\Delta_f H_{\{CY\ldots\}},$$

and the change in Gibbs free energy (ΔG) can be given by:

$$\Delta G=\Delta_f G_{AB\{C\ldots\}}+\Delta_f G_{AY}-\Delta_f G_{BY}-\Delta_f G_{\{CY\ldots\}},$$

where the product term AB{C . . . } represents any possible combination of metallic phases, such as "ABC", AB+AC", AB+BC", "AC+BC", "A+B+C" etc.

In terms of notation, the two primary types of reactions can be written in a combined basic form as:

$$A+BY \longrightarrow (A)B+AY-\Delta H,$$

and the resulting heat of reaction (ΔH) can be given by:

$$\Delta H=\Delta_f H_{(A)B}+\Delta_f H_{AY}-\Delta_f H_{BY},$$

and the change in Gibbs free energy (ΔG) can be given by:

$$\Delta G=\Delta_f G_{(A)B}+\Delta_f G_{AY}-\Delta_f G_{BY},$$

where the term "(A)B" means the element "A" may or may not react to form a chemical compound with element "B", and this notation can further be generalized to include additional reactant compounds, described in general form as:

$$A+BY+\{CY\} \longrightarrow (A)B\{C\ldots\}+AY-\Delta H,$$

and the resulting heat of reaction (ΔH) can be given by:

$$\Delta H=\Delta_f H_{(A)B\{C\ldots\}}+\Delta_f H_{AY}-\Delta_f H_{BY}-\Delta_f h_{\{CY\ldots\}},$$

and the change in Gibbs free energy (ΔG) can be given by:

$$\Delta G=\Delta_f G_{(A)B\{C\ldots\}}+\Delta_f G_{AY}-\Delta_f G_{BY}-\Delta_f G_{\{CY\ldots\}}.$$

Additionally, it is also possible to include in the in situ matrix composite material elements or compounds ("X") which do not directly participate in the exothermic reaction, but which are integral to the reaction product. The addition of "X" can be described in its basic form as:

$$A+BY+X \longrightarrow (A)B+AY+X-\Delta H$$

and the resulting heat of reaction (ΔH) can be given by:

$$\Delta H=\Delta_f H_{(A)B}+\Delta_f H_{AY}-\Delta_f H_{BY},$$

and the change in Gibbs free energy (ΔG) can be given by:

$$\Delta G=\Delta_f G_{(A)B}+\Delta_f G_{AY}-\Delta_f G_{BY}.$$

It is noted that the compound "X" is not included in the calculation of the heat reaction or the Gibbs free energy because it does not participate directly in the chemical reaction.

The formula can be further generalized to include additional reactant compounds "{CY . . . }" or additional non-reactive elements or compounds "{X}", described in general form as:

$$A+BY+\{CY\ldots\}+\{X\ldots\} \longrightarrow (A)B\{C\ldots\}+AY+\{X\ldots\}-\Delta H,$$

and the resulting heat of reaction (ΔH) can be given by:

$$\Delta H=\Delta_f H_{(A)B\{CY\ldots\}}+\Delta_f H_{AY}-\Delta_f H_{BY}-\Delta_f H_{\{CY\ldots\}},$$

and the change in Gibbs free energy (ΔG) can be given by:

$$\Delta G=\Delta_f G_{(A)B\{CY\ldots\}}+\Delta_f G_{AY}-\Delta_f G_{BY}\Delta_f G_{\{CY\ldots\}},$$

When manufacturing materials for science and engineering applications using SHS, processes involving a simple blending and activation of the reactants are generally ineffective. One significant and frequently occurring limitation with respect to SHS processes known to the prior art, is that they can yield materials exhibiting substantial porosity, as disclosed in, for example, United States Patent Application No. 2006/0032558. The presence of porosity can be undesirable, as it generally negatively affects the material properties of the formed product, such as, for example, material strength.

Another significant shortcoming to the known techniques of performing SHS reactions is the requirement for an external ignition source, generally provided in the form of a spark or fuse, contact with tooling at high temperature, or placement of the reactants in a high temperature furnace. The need for an external ignition source has restricted the development of SHS processes for articles of manufacture at industrial scale. Similarly, the high temperature of tooling in contact with blended powder reactants for the purpose of ignition frequently exceeds the maximum use temperature of tool steels. This poses additional limitations on SHS processes, such as form factors, inadequate control over thermal management processes for tooling or the product, inefficient cycle times for article production, high energy costs and a limited tool lifespan.

Yet another drawback of SHS processes known to the art is that the reaction rates are frequently slow and known processes can be susceptible to stalling or incomplete reaction due to heat loss from the reacting compounds to the environment, for example, the surrounding atmosphere, tooling or an inert gas, such as can be present in a furnace.

Thus, there are numerous shortcomings associated with known SHS processes, and there remains a need for techniques for performing such processes.

SUMMARY

The following paragraphs are intended to introduce the reader to the more detailed description that follows and not to define or limit the claimed subject matter.

The present disclosure relates to SHS reactions, and to materials and techniques for the performance of SHS reactions, including substantially dense shaped articles formed of metallic compounds.

In an aspect of the present disclosure, a method of manufacturing an article is provided. The method can comprise: providing a first particulate comprising a first reactant that is a metallic element or metallic chemical compound; providing a second particulate comprising a second reactant that is a metallic element or metallic chemical compound; blending the first and second particulates to form a particulate blend; preforming the particulate blend to form a preform article; heating the preform article to a pre-heat temperature being below an auto-activation temperature and above a minimum compression activated synthesis temperature; and exerting compressive stress on the preform article at the pre-heat temperature to (i) initiate a self-propagating high-temperature synthesis reaction between the first and second reactants and thereby form a product metallic compound, and (ii) at approximately peak temperature, exceed a flow stress of the product metallic compound to reduce porosity of the product metallic compound and thereby form the article.

At the pre-heat temperature, the first and second reactants can be extant in solid form. At pre-heat temperature, the first reactant can be extant in liquid form, and the second reactant can be extant in solid form.

Prior to the step of blending, the first particulate can have a mean particle size of between about 1 μm and about 100 μm. Prior to the step of blending, the second particulate can have a mean particle size of between about 0.1 μm and about 3 μm. Prior to the step of blending, the mean particle size of the first particulate can be at least three times the mean particle size of the second particulate.

The first particulate can have an elastic modulus that is less than an elastic modulus of the second particulate. The first particulate can have a melting temperature that is less than a melting temperature of the second particulate.

The first particulate can consist of at least 95% (w/w) of the first metallic element or metallic chemical compound, and the second particulate can consist of at least 95% (w/w) of the second metallic element or metallic chemical compound.

The step of preforming can comprise at least one of cold pressing and hot pressing the particulate blend to form the preform article.

The step of blending can comprise blending an additive agent to the particulate blend. The additive agent can convey at least one structural and/or functional material property to the article. The additive agent in the self-propagating high-temperature synthesis reaction can chemically reacts with at least one of the first reactant and the second reactant. Alternatively, the additive agent in the self-propagating high-temperature synthesis reaction does not chemically react with the first reactant and the second reactant.

The self-propagating high-temperature synthesis reaction can be characterized by a $\Delta H<0$ and a $\Delta G<0$.

After the step of preforming, the preform article can have a near net shape.

The step of exerting can comprise maintaining the compressive stress approximately constant for a period starting approximately when the auto-activation temperature is achieved and ending approximately when the article has been formed. The step of exerting can comprise increasing the compressive stress during a period starting approximately when the auto-activation temperature is achieved and ending approximately when the article has been formed. The period can last from about 1 second to about 1 minute.

At least one of the first and second reactants can consist substantially of two or more bonded metallic elements.

At least one of the first and second reactants can consist substantially of a metallic element bonded to a non-metallic element.

At least one of the first and second reactants can consist substantially of a metallic element selected from the group consisting of Ag, Al, Fe, Mg, Ni, and Ti.

At least one of the first and second reactants can consist substantially of a metallic element selected from the group consisting of Ag, Al, Fe, Mg, Ni, and Ti bonded to another metallic element.

At least one of the first and second reactants can consist substantially of a metallic element selected from the group consisting of Ag, Al, Fe, Mg, Ni, and Ti, the metallic element bonded to a non-metallic element.

At least one of the first and second reactants can be selected from the group consisting of a metal-boride, a metal-carbide, a metal-nitride, and a metal-oxide.

The product metallic compound can consist substantially of two chemically bonded metallic elements.

The product metallic compound can consist substantially of a metallic matrix composite. The metallic matrix composite can comprise a mechanically blended reinforcement. The metallic matrix composite can comprise an in situ formed reinforcement.

The first reactant can consist substantially of Al, the second reactant can consist substantially of $TiO_2$, and the product metallic compound can consist substantially of a metallic matrix composite comprising TiAl in situ reinforced with $Al_2O_3$.

The article can have a porosity of 2% or less, or 1% or less.

In an aspect of the present disclosure, an article can be manufactured by the methods described herein. The article can be substantially dense and shaped. The article can have a porosity of about 2% or less, or 1% or less. The article can comprise less than about 1% (w/w) of unreacted first and second reactants.

Other features and advantages of the present disclosure will become apparent from the following detailed description. It should be understood, however, that the detailed description, while indicating preferred embodiments of the disclosure, are given by way of illustration only, since various changes and modifications within the spirit and scope of the disclosure will become apparent to those of skill in the art from the detailed description.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Figure 1:
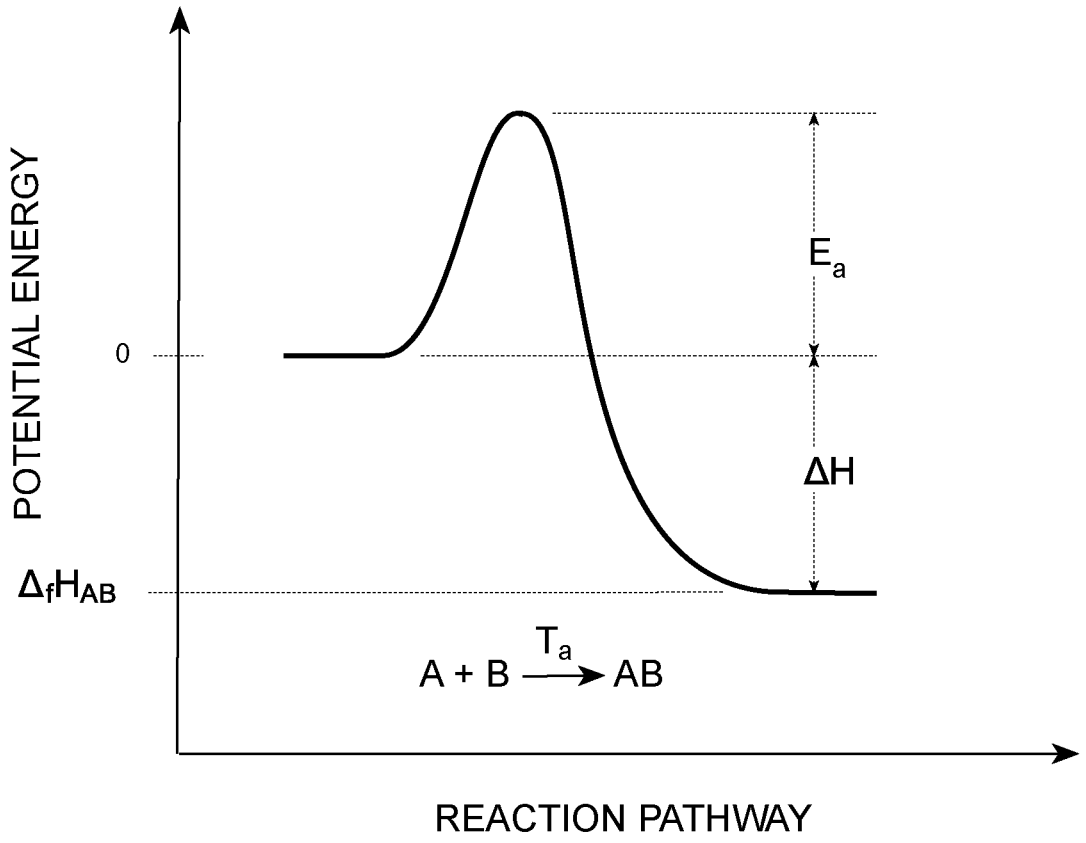
FIG. 1 is a graph illustrating, in general, the potential energy of a chemical reaction to form compound AB from reactants A and B as a function of the reaction pathway, wherein the reaction has a negative $\Delta H$, i.e. the reaction is exothermic and releases heat equal to $\Delta H$. The amount of energy necessary to cause the reaction to proceed is denoted as the activation energy ($E_a$), and the relationship between $E_a$, and $\Delta H$ is shown. The $\Delta_f H_{AB}$, representing the enthalpy of formation for the compound AB is also shown.
Figure 2:
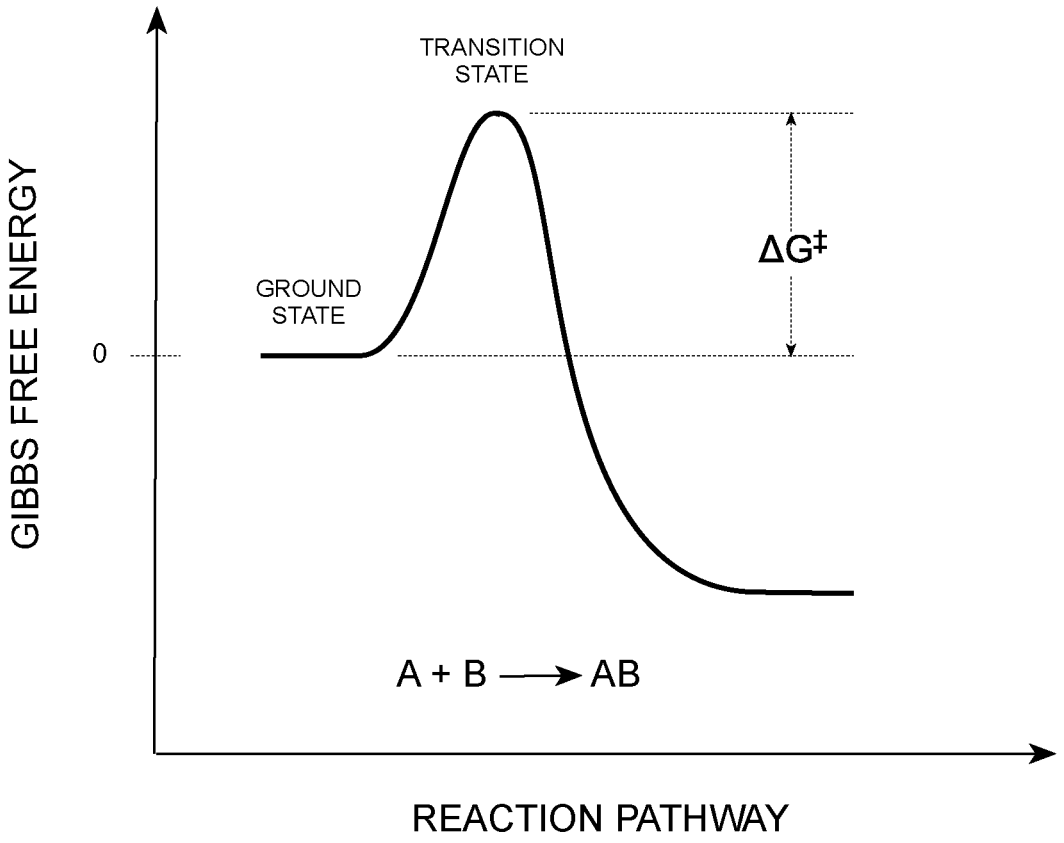
FIG. 2 is a graph illustrating, in general, the Gibbs free energy ($\Delta G$) of a chemical reaction to form compound AB from reactants A and B as a function of the reaction pathway, wherein the reaction has a negative $\Delta G$, i.e. the reaction is spontaneous. The amount of energy necessary to cause the reaction to proceed from its ground state to its transition state is denoted as Gibbs energy of activation ($\Delta G^{\ddagger}$).

Various apparatuses, methods or compositions will be described below to provide an example of an embodiment of each claimed invention. No embodiment described below limits any claimed invention and any claimed invention may cover apparatuses, methods and compositions that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Terms and Definitions

As used herein and in the claims, the singular forms, such "a", "an" and "the" include the plural reference and vice versa unless the context clearly indicates otherwise. Throughout this specification, unless otherwise indicated, "comprise", "comprises" and "comprising" are used inclusively rather than exclusively, so that a stated integer or group of integers may include one or more other non-stated integers or groups of integers.

The term "or" is inclusive unless modified, for example, by "either".

When ranges are used herein for physical properties, such as molecular weight, or chemical properties, such as chemical formulae, all combinations and sub-combinations of ranges and specific embodiments therein are intended to be included. Other than in the operating examples, or where otherwise indicated, all numbers expressing quantities of ingredients or reaction conditions used herein should be understood as modified in all instances by the term "about". The term "about" when referring to a number or a numerical range means that the number or numerical range referred to is an approximation within experimental variability (or within statistical experimental error), and thus the number or numerical range may vary between 1% and 15% of the stated number or numerical range, as will be readily recognized by context. Furthermore, any range of values described herein is intended to specifically include any intermediate value or sub-range within the given range, and all such intermediate values and sub-ranges are individually and specifically disclosed (e.g., 1 to 5 includes 1, 1.5, 2, 2.75, 3, 3.90, 4, and 5). Similarly, other terms of degree such as "substantially" and "approximately" as used herein mean a reasonable amount of deviation of the modified term such that the end result is not significantly changed. These terms of degree should be construed as including a deviation of the modified term if this deviation would not negate the meaning of the term it modifies.

Unless otherwise defined, scientific and technical terms used in connection with the formulations described herein shall have the meanings that are commonly understood by those of ordinary skill in the art. The terminology used herein is for the purpose of describing particular embodiments only, and is not intended to limit the scope of the present invention, which is defined solely by the claims.

The symbol "ΔG", as used herein, refers to the change in Gibbs free energy of a chemical reaction, which, for a given chemical reaction, can be expressed in Joules and be positive or negative (or 0) and can be calculated, experimentally determined, or identified in a standard chemical reference work, such as *Thermochemical Data of Pure Substances* by Ihsan Barin, (1995) 3$^{rd}$ edition, Wiley-VCH Verlag, Weinheim, Germany.

The symbol "ΔH", as used herein, refers to the heat of a chemical reaction, alternatively the enthalpy of reaction, which, for a given chemical reaction, can be can be expressed in Joules and be positive or negative (or 0) and can be calculated, experimentally determined or determined from a or identified in a standard chemical reference work, such as *Thermochemical Data of Pure Substances* by Ihsan Barin, (1995) 3$^{rd}$ edition, Wiley-VCH Verlag, Weinheim, Germany.

The term "auto-activation temperature", or the symbol "$T_a$", as can be interchangeably used herein, refers to the temperature at which an SHS reaction between two or more reactants, provided, for example, in the form of a preform-article, can be initiated when the reactants are heated to such temperature. The $T_a$ can vary as a function of compressive stress exerted on the two or more reactants. The actual temperature $T_a$ can vary for different combinations of reactants.

The term "blend", as used herein, refers to a composition comprising at least two chemical reactants. The reactants constituting the blend can be more or less homogenously distributed. Blends can comprise solid compounds, for example, particulate compounds.

The term "chemical compound", as used herein, can refer to a chemical element chemically bonded to one or more other chemical elements.

The term "chemical element", as used herein, refers to any chemical element as set forth in the Periodic Table of Chemical Elements, with which those of skill in the art will be familiar.

The term "reactant", as used herein, refers to any chemical element or chemical compound that can be used as a constituent of an article, such as a preform, and subjected to an SHS reaction.

The term "minimum compression activated synthesis temperature" or the symbol "$T_{a\text{-}min}$", as can be interchangeably used herein, refers to the minimum temperature at which an SHS reaction between two or more reactants can be initiated at the exertion of an exogenous compressive stress. The actual temperature $T_{a\text{-}min}$ can vary for different combinations of reactants.

The term "flow stress temperature" or the symbol "$T_f$", as can be used herein interchangeably, is the temperature at which a material, a product chemical compound, for example, can be plastically deformed.

The term "metallic compound", as used herein, refers to a chemical compound comprising at least one metallic element chemically bonded to another chemical element. The metallic element can be bonded to one or more other metallic elements, such as in titanium aluminide or nickel aluminide, or the metallic element can be bonded to one or more non-metallic elements, such as in aluminum oxide or titanium dioxide, or the metallic element can be bonded to one or more other metallic elements and to one or more non-metallic elements, such as in titanium aluminum nitride or titanium aluminide carbide.

The term "metallic element", as used herein, can refer to any one of the following chemical elements: Li, Be, Na, Mg, Al, K, Ca, Sc, Ti, V, Cr, Mn, Fe, Co, Ni, Cu, Zn, Ga, Rb, Sr, Y, Zr, Nb, Mo, Tc, Ru, Rh, Pd, Ag, Cd, In, Sn, Cs, Ba, Hf, Ta, W, Re, Os, Ir, Pt, Au, Hg, Tl, Pb, Bi, Po, Fr, Ra, Rf, Db, Sg, Bh, Hs, Mt, Ds, Rg, Uub, Uut, Uuq, Uup, or any of the lanthanides or actinides.

The term "near net shape", as used herein, refers to a three dimensional geometrical shape of an article, for example, a preform, which closely approximates the three dimensional geometrical shape of a final article, not requiring substantial mechanical finishing techniques, such as cutting or machining.

The term "non-metallic element", as used herein, refers to any chemical element that is not a metallic element.

The terms "preform" and "preforming", as used herein, refer to an article or a method of forming an article having a predetermined desired three-dimensional geometry.

The term "pre-heat temperature", or the symbol "$T_p$" as interchangeably used herein, refers to a temperature within a temperature range above the compression activated synthesis temperature but below the auto-activation temperature. The actual temperature $T_p$ can vary for different combinations of reactants.

The term "reinforcement agent", as used herein, refers to a chemical compound conveying a structural or functional material property to a substantially dense article upon formation of the product metallic compound in an SHS reaction. A reinforcement agent can either chemically react, or not chemically react in an SHS reaction.

The term "supplemental agent", as used herein, refers to a chemical compound that can facilitate one or more steps of a method conducted in accordance with the present disclosure without conveying structural or functional material properties to a product metallic compound.

Various chemical elements and chemical compositions can be referred herein interchangeably either by using one, two or three letter identifiers for chemical elements in accordance with the Periodic Table of Chemical Elements, or by using their full chemical name, such as "aluminum" or "Al", "titanium dioxide" or "$TiO_2$", and "aluminum oxide" or "$Al_2O_3$".

All publications, patents and patent applications are herein incorporated by reference in their entirety to the same extent as if each individual publication, patent or patent application was specifically and individually indicated to be incorporated by reference in its entirety.

General Implementation

In overview, it has been realized that a method can be performed to manufacture substantially dense shaped articles from near net shape preform articles constituted of reactants. In some embodiments, the method comprises initially heating the preform article to a pre-heat temperature, and then, at pre-heat temperature, exerting sufficient compressive stress on the preform to conduct an SHS reaction between the reactants to form a product metallic compound and to thereby form the substantially dense shaped article.

The methods of the present disclosure can reduce material porosity and provide substantially dense shaped articles. Furthermore, the methods of the present disclosure do not require an external ignition source to initiate the SHS reaction and the methods can be performed using tools operated at a temperature below the pre-heat temperature. As the tool temperatures can be kept only moderately high, commonly used tool materials, such as standard tool steels can be used, and indeed, re-used, so that the methods of the present disclosure allow for a long tool lifespan. Moreover, the SHS reaction can be fast and can allow for a rapid release of heat, permitting a full and complete reaction between the reactants. The SHS reaction can also be performed in a manner in which the reaction product during a brief period can have a flow stress that permits hot working.

Figure 3:
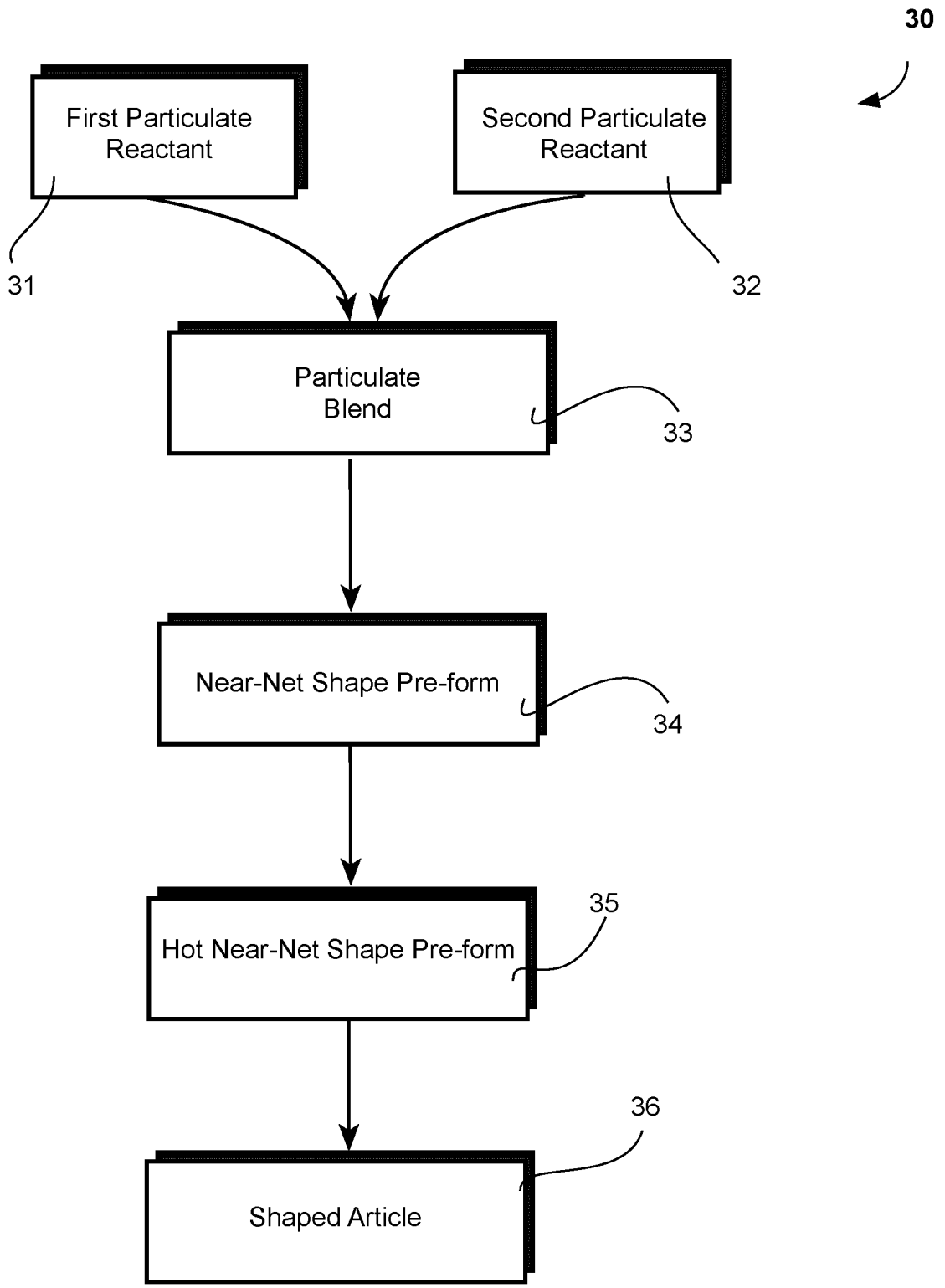
FIG. 3 is a schematic block diagram illustrating an example embodiment of a method for making a substantially dense shaped article.

Referring now to FIG. 3, a method 30 is shown for preparing a substantially dense shaped article 36. The method 30 can comprise a first step comprising providing and blending a first particulate reactant comprising or consisting of a metallic element or metallic compound 31, with a second particulate reactant comprising or consisting of a metallic element or metallic compound 32, to form particulate blend 33. The method 30 can next comprise a second step comprising preforming the particulate blend 33 to form preform article 34 having a near net shape. The method 30 can next comprise a third step comprising increasing the temperature of preform article 34 to a pre-heat temperature, which is lower than the auto-activation temperature and higher than the compression activated synthesis temperature of first reactant comprising a metallic element or compound 31 and second reactant comprising a metallic element or compound 32 constituting preform article 34 to obtain hot near net shape preform 35. The method 30 can next comprise a fourth step comprising exerting for a sufficiently long period of time sufficient exogenous compressive stress on hot preform article 35 at the pre-heat temperature to thereby initiate and perform an SHS reaction between first particulate comprising reactant 31 and second particulate comprising reactant 32 to form substantially dense shaped article 36. Substantially dense shaped article 36 is constituted of a product metallic compound, being the SHS-reaction product of first particulate comprising reactant 31 and second particulate comprising reactant 32. At pre-heat temperature the first reactant 31 can exist in solid or liquid form. As hereinafter provided in further detail, the exogenous compressive stress can be selected to be sufficient to initiate an SHS reaction and initially form a porous SHS reaction product comprising metallic compound product. The initial product metallic compound is a product formed in a chemical reaction between the first and the second reactants. The chemical reaction can be characterized by a $\Delta H<0$ and a $\Delta G<0$. The exogenous compressive stress can further be selected to be sufficient to, thereafter, as the SHS reaction achieves approximately peak temperature, overcome the flow stress of the initially formed porous SHS reaction product and form a dense SHS reaction product to thereby form the shaped article.

To initiate the methods provided in the present disclosure, a first particulate comprising a first reactant is provided or obtained and a second particulate comprising a second reactant is provided or obtained. The first particulate and second particulate can have a range of particle sizes. In some embodiments, the mean particle size of the first particulate can range from about 1 μm to about 100 μm, inclusive. The mean particle size can be, for example, be about 5 μm, about 10 μm, about 15 μm, about 20 μm, about 25 about μm, 30 μm, 35 μm, 40 μm, 45 μm, 50 μm, 55 μm, 60 μm, 65 μm, 70 μm, 75 μm, 80 μm, 85 μm, 90 μm, 95 μm or about 100 μm. In some embodiments, the mean particle size of the second particulate can range from about 0.1 μm to about 3 μm, inclusive, for example, the mean particle size can be about 0.1 μm, about 0.25 μm, about 0.5 μm, about 0.75 μm, about 1 μm, about 1.5 μm, about 2 μm about 2.5 μm or about 3 μm. In some embodiments, the mean particle size of the first particulate reactant can be at least about 3× the particle size of the second particulate reactant, for example, the mean particle size of the first particulate can be about 3×, about 4×, about 5×, about 6×, about 7×, about 8×, about 9×, about 10×, about 15×, about 20× or about 30× the mean particle size of the second particulate reactant. The particles can be homogenously sized, i.e. the particles can have a tightly centered mean particle size, e.g., 90% of the particles can have a particle size not exceeding ±20% of the mean particle size, or 90% of the particles can have a particle size not exceeding ±10%, the particles can have a not exceeding ±5% of the mean particle size.

In some embodiments, the first particulate can have a lower elastic modulus than the second particulate. Thus, for example, in some embodiments, the first particulate reactant can have an elastic modulus ranging from about 10 GPa to about 200 GPa, and the second particulate compound can have an elastic modulus ranging from about 100 GPa to about 1,000 GPa, wherein the elastic modulus of the first particulate is at least about 2× times the elastic modulus of the second particulate.

In some embodiments, the first particulate can have a lower melting point than the second particulate, for example, the first particulate can have a melting point of about 10° C., about 25° C., about 50° C., about 100° C., about 150° C., about 200° C., or about 250° C. below the melting point of the second particulate. In some embodiments, the first particulate can have a melting below the pre-heat temperature, for example, about 10° C., about 25° C., about 50° C., about 100° C., about 150° C., about 200° C., or about 250° C. below the pre-heat temperature. Thus, it will be clear that in these embodiments, upon increasing the temperature of the preform the first particulate in accordance with a method of the present disclosure, the first particulate can liquefy.

The first and second particulates are constituted to comprise a first and second reactant, respectively. The purity of the first and second particulate can vary, however the first and second particulate are generally substantially pure and constituted to comprise at least 95% (w/w) of the reactant metallic compound. In some embodiments, the particulate purity is at least about 98%, at least about 99%, at least about 99.9% or at least about 99.99%. In such embodiments, the particulate is constituted to comprise at least about 98% (w/w), at least about 99% (w/w), at least 99.9% (w/w), or at least 99.99%, respectively, of the first or the second reactant, respectively. The material balance can comprise trace metallic elements.

A variety of first and second reactants can be selected. In general, first and second reactants selected to conduct a method according to embodiments of the present disclosure, are reactants capable of forming a product metallic compound pursuant to a chemical reaction exhibiting a $\Delta G<0$ and a $\Delta H<0$. In general, the $\Delta G$ or $\Delta H$ of a given chemical reaction between a first and second reactants can be determined with reference to standard chemical literature documenting physical and chemical properties of chemical compounds, for example, *Thermochemical Data of Pure Substances* by Ihsan Barin, (1995) 3rd edition, Wiley-VCH Verlag, Weinheim, Germany. Alternatively, the $\Delta G$ or $\Delta H$ can be experimentally determined, for example, as described in: *An Introduction to Chemical Metallurgy: International Series on Materials Science and Technology* Volume 26 of International series on materials science and technology; Pergamom international library of science, technology, engineering and social studies, R. H. Parker and D. W. Hopkins (2016), 2nd revised edition, Elsevier, and many publications on the subject of chemical thermodynamics, as will be known by those of skill in the art. In some embodiments, the first reactant can be a reactant metallic element.

In some embodiments, the second reactant can be a particulate reactant metallic element.

In some embodiments, the first and second reactants can each be reactant metallic elements.

In some embodiments, the first reactant can comprise or consist of a reactant metallic compound.

In some embodiments, the second particulate reactant can comprise or consist of a reactant metallic compound.

In some embodiments, the first and second reactants can each comprise or consist of reactant metallic compounds.

In some embodiments, the first reactant can comprise or consist of a metallic element selected from the group consisting of Ag, Al, Fe, Mg, Ni, and Ti.

In some embodiments, the second reactant can comprise or consist of a metallic element selected from the group consisting of Ag, Al, Fe, Mg, Ni, and Ti.

In some embodiments, the first and the second particulate reactants can comprise or consist a metallic element selected from the group consisting of Ag, Al, Fe, Mg, Ni, and Ti.

In some embodiments, the first reactant can comprise or consist of a metallic element selected from the group consisting of Ag, Al, Fe, Mg, Ni, and Ti, the metallic element bonded to another metallic element.

In some embodiments, the second reactant can comprise or consist of a metallic element selected from the group consisting of Ag, Al, Fe, Mg, Ni, and Ti, the metallic element bonded to another metallic element.

In some embodiments, the first and the second reactants can comprise or consist a metallic element selected from the group consisting of Ag, Al, Fe, Mg, Ni, and Ti, the metallic element bonded to another metallic element.

In some embodiments, the first reactant can comprise or consist of a metallic element selected from the group consisting of Ag, Al, Fe, Mg, Ni, and Ti, the metallic element bonded to a non-metallic element.

In some embodiments, the second reactant can comprise or consist of a metallic element selected from the group consisting of Ag, Al, Fe, Mg, Ni, and Ti, the metallic element bonded to a non-metallic element.

In some embodiments, the first and the second reactants can comprise or consist a metallic element selected from the group consisting of Ag, Al, Fe, Mg, Ni, and Ti, the metallic element bonded to non-metallic element.

In some embodiments, the first reactant can be selected from the group consisting of a metal-boride, a metal-carbide, a metal-nitride, and a metal-oxide.

In some embodiments, the second reactant can be selected from the group consisting of a metal-boride, a metal carbide, a metal-nitride, and a metal-oxide.

In some embodiments, the first and second reactants can each be selected from the group consisting of a metal-boride, a metal carbide, a metal-nitride, and a metal-oxide.

Next, the first particulate comprising a first reactant and a second particulate comprising a second reactant can be blended, by contacting the first and second particulates in a suitable receptacle and blending the two particulates. In order to blend the particulates, a stirring or mixing device suitable for mixing particulates can be used, for example, a mechanical mixing device, such as a ball mill. Suitable receptacles include containers or vessels that can withstand temperatures used in subsequent heating steps, including containers or vessels made from heat resistant materials such as porcelain, graphite or an inert metal. Contacting and blending of the particulates can be conducted at room temperature. Upon blending of the first and second particulate a more or less homogenous particulate blend comprising a first reactant and a second reactant can be obtained.

The relative quantities of first and second particulate used for blending can vary. In some embodiments, the quantities can be selected with reference to the chemical reaction conducted. In some embodiments, quantities of the first and second particulate can correspond with stoichiometric quantities of a first and second reactant. Thus, for example, in a method conducted using aluminum and titanium dioxide in accordance with the following chemical reaction:

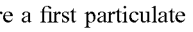

$$7Al+3TIO_2 \longrightarrow 3TiAl+2Al_2O_3,$$

where a first particulate comprising 7 molar equivalents of aluminum and a second particulate comprising 3 molar equivalents of titanium dioxide can be selected.

In some embodiments, additive agents can be included in the particulate blend.

In some embodiments, additive agents can be supplemental agents, i.e. agents that can facilitate one or more of the steps of a methods conducted in accordance with embodiments of the present disclosure, without conveying, structural or functional material properties to a product metallic compound formed in an SHS reaction performed in accordance with embodiments of the present disclosure. In some embodiments, the supplemental agent can facilitate a particulate blending step, for example, an organic solvent, such as acetone or isopropyl alcohol. In other embodiments, the supplemental agent can be a binder, such as an inorganic binder, for example, magnesium aluminum silicate, or an organic binder, such as carboxymethylcellulose, which can be used to facilitate a preforming step.

In some embodiments, additive agents can be reinforcement agents i.e. agents which can convey structural material properties, for example, material strength or hardness, or functional material properties, for example, electrical conductivity, to a substantially dense shaped article upon formation of product metallic compound in an SHS reaction. Product metallic compounds formed in accordance with the present disclosure comprising reinforcement agents can also be referred to herein as "metallic matrix composites". In general, in some embodiments, reinforcement agents can be chemical compounds that chemically form as a result of the conducted SHS reaction. Such reinforcement agents can be said to in situ form a chemical compound in the SHS reaction. In other embodiments, reinforcement agents can be chemical compounds that do not chemically react in the subsequently conducted SHS reaction.

Quantities of reinforcement agents used for inclusion in a particular blend can vary. In some embodiments, quantities of reinforcement agents can be selected with reference to a chemical reaction conducted. In some embodiments, quantities of reinforcement agents can be stoichiometric. Thus, for example, in a method conducted using in accordance with the following chemical reaction:

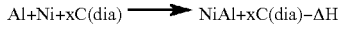

$$Al+Ni+xC(dia) \longrightarrow NiAl+xC(dia)-\Delta H$$

where a reinforcement agent comprising or consisting of x molar equivalents of carbon (C) in diamond form can be selected.

In some embodiments, reinforcement agents can be compounds comprising a metallic element bonded to a non-metallic element, for example, titanium silicide ($Ti_5Si_3$) or a non-metallic element bonded to another non-metallic element, for example, silicon carbide (SiC).

In some embodiments, additive agents can be alloying chemical elements. In some embodiments, an alloying chemical element can be included in a particulate blend by providing or obtaining a metallic compound constituting an alloy. Examples of alloying elements that can be included are elemental Ag, Al, Fe, Mg, Ni, or Ti.

Additive agents can be included in the blend in any desired form, for example, as a particulate or a liquid.

Next, the particulate blend comprising first and second reactants and, optionally, one or more additive agents, can be preformed by shaping the particulate blend to obtain a preform article having a near net shape. In some embodiments, the particulate blend can be preformed by compressing the particulate blend in a die at a force of a sufficient magnitude to bind the first and second particulates, and thereby form a near net shaped self-supporting preform article having a single solid body. In some embodiments, the three dimensional geometric dimensions of the die can be regular in shape. Thus, for example, a cylindrical sleeve, such as a cylindrical steel sleeve, can be used as a receptacle for a particular blend. A cylinder, such as a solid steel cylinder, that matchingly fits in the sleeve can then be used to mediate a compressive stress on the particulate blend. The compressive stress can be exerted by a mechanical device, for example, the compressive stress can be exerted by a mechanical or a hydraulic press. The compressive stress can vary in magnitude and can be substantial, ranging, for example, from about 1 MPa to about 500 MPa, for example, about 10 MPa, about 100 MPa, about 250 MPa, about 500 MPa. In general, compression results in a reduction in volume of the blend. In other embodiments, irregularly shaped preform articles can be formed using corresponding dies. The three-dimensional geometry of the preform article is selected to approximate the three-dimensional geometry of the final desired finished article (i.e. the preform article is near net shaped), however, in different embodiments, the three-dimensional geometry can be varied, and selected as desired.

In some embodiments, the particulate blend can be cold-pressed to form a preform article, i.e. a compressive stress is applied to the particulate blend at ambient temperature, without the application of heat to the particulate blend from an external heat source.

In some embodiments, the particulate can be hot pressed to form a preform article, i.e. a compressive stress is applied to a hot particulate blend. The compressive stress can be applied after or during the application of external heat to a particulate blend. The application of heat to the blend can increase the temperature of the blend well above ambient temperature. Thus, for example, the temperature of a particulate mixture can be increased in a furnace to approximately 100° C., 200° C., 300° C. 350° C. or 400° C. The particulate blend can then be removed from the furnace and immediately thereafter pressed.

Next, the preform article can then be heated to a temperature below the auto-activation temperature, but above the minimum compression activated synthesis temperature, to a temperature referred herein as the pre-heat temperature, and thereafter an SHS synthesis reaction can be conducted, as described herein after with particular reference to FIGS. 4A, 4B, 4C, 4D, 5 and 6.

Figure 5:
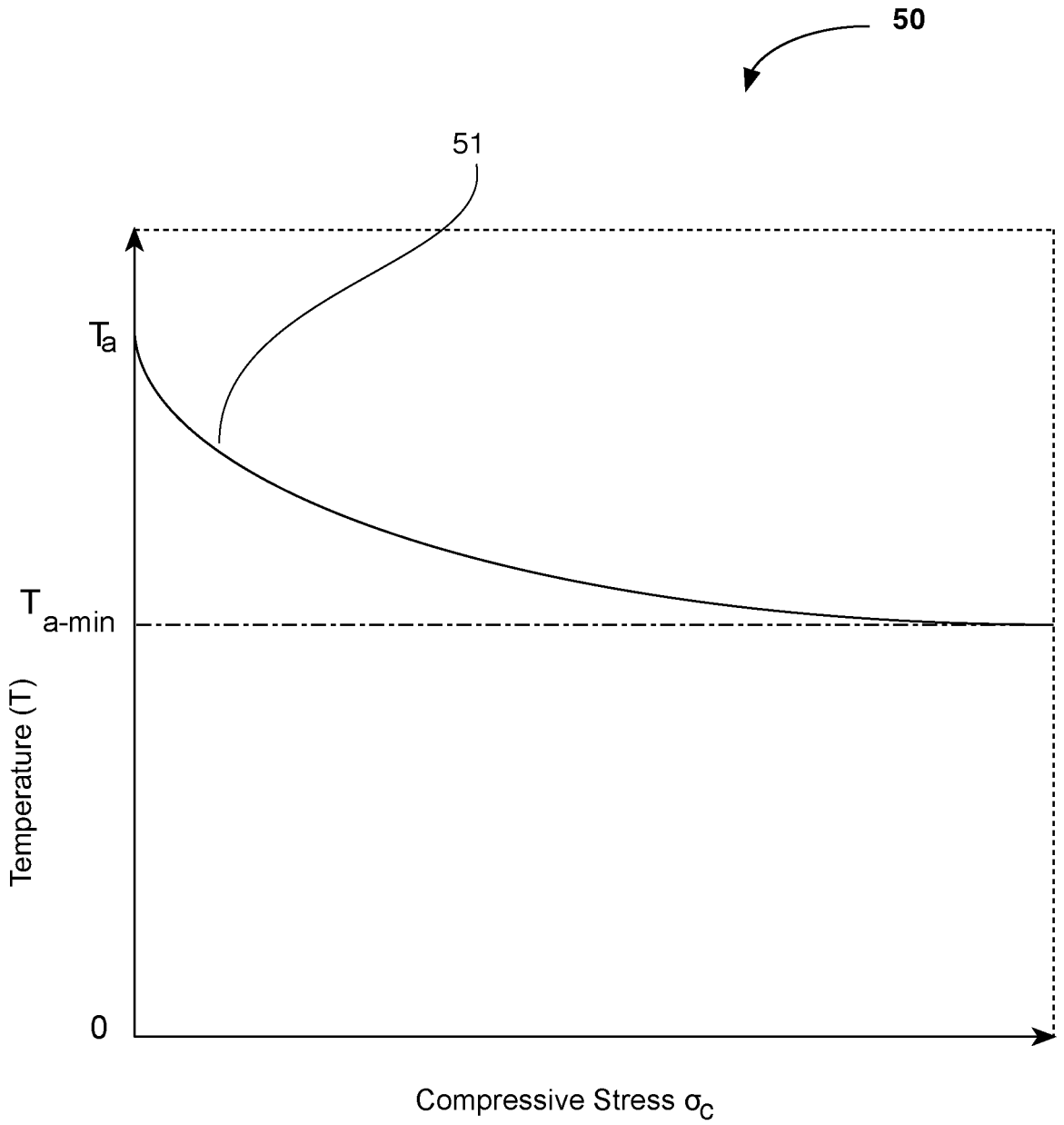
FIG. 5 is a graph illustrating, in general, the functional relationship between the auto-activation temperature and compressive stress exerted on example reactants.

As illustrated in FIG. 5, graph 50 shows that the pre-heat $T_p$ for a given first reactant and a second reactant is a temperature selected to be below the activation temperature $T_a$, and above the minimum compression activated synthesis temperature $T_{a\text{-}min}$. This can involve increasing the temperature of the preform starting from ambient temperature, for example, by placing the preform article being held in a heat resistant receptacle, such as a steel container, in a temperature controlled furnace capable of heating the preform to a temperature $T_p$. In some embodiments, the temperature of the preform article can be increased under ambient atmospheric conditions. In some embodiments, the temperature of the preform article can be increased under controlled atmospheric conditions, for example, in a furnace in which the flow of an inert gas, such as nitrogen or argon, can be controlled. The activation temperature $T_a$ varies as a function of exogenous compressive stress ($\sigma_c$) applied to the reactants. Thus, as shown in FIG. 5, an activation temperature curve 51 can be defined.

The values for $T_a$ and $T_{a\text{-}min}$ for different combinations of first and second reactants can vary. $T_a$ values are generally at least about 100° C., and in different embodiments can be at least about 250° C., at least about 500° C., at least about 750° C., at least about 1,000° C., or at least about 1,250° C. $T_a$ values at atmospheric pressure generally substantially exceed $T_{a\text{-}min}$ values, for example, for different selected combinations of a first and second reactants $T_a$ can be at least about 50° C. higher than $T_{a\text{-}min}$, or at least about 100° C. higher, or at least about 250° C. higher, or at least about 500° C. higher. Thus, in these embodiments, the temperature $T_p$ is selected within a range of temperatures of about 50° C., 100° C., 250° C. or 500° C., respectively. The activation temperature $T_a$ and the minimum compression activated synthesis temperature $T_{a\text{-}min}$ for a given combination of a selected first reactant and a second reactant at different compressive stress can be determined experimentally.

In some embodiments, as the temperature is increased, the first reactant can liquefy so that at a temperature $T_p$ the first reactant is extant in liquid form.

In some embodiments, as the temperature is increased the first reactant metallic compound and second metallic compound remain extant in solid form.

Next, the heated preform can be placed in a tool or die, for example, a steel tool or die, having a cavity to matchingly fit the heated preform. While the preform has a temperature $T_p$, compressive stress $\sigma_c$ can be exerted on the preform.

Figure 6:
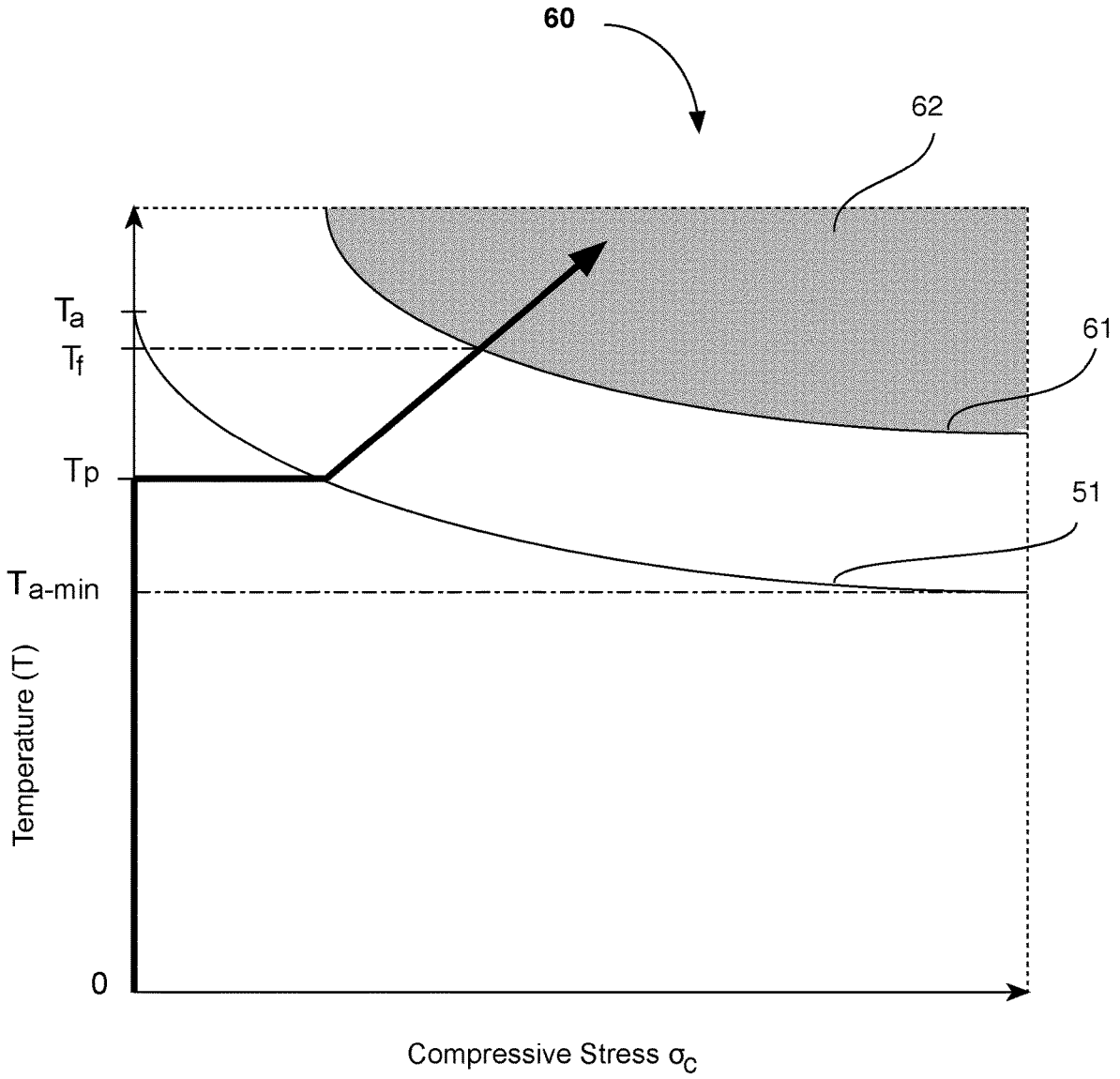
FIG. 6 is a graph illustrating, in general, the functional relationship between the auto-activation temperature and compressive stress exerted on example reactants, and the functional relationship between the flow-stress temperature and compressive stress exerted on the reactants.

As illustrated in FIG. 6, graph 60 shows that as compressive stress ($\sigma_c$) is increased, $T_a$ can be achieved, and at $T_a$ an SHS reaction between the first and second reactant metallic compounds is initiated.

Figure 4A:
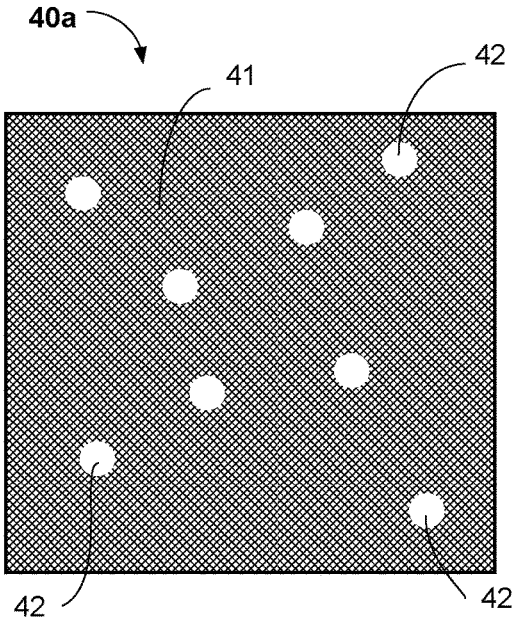
FIGS. 4A, 4B, 4C and 4D are sketches of example cross-sectional microscopic views of a portion of the microstructure of a near net shaped preform article as an SHS reaction proceeds within the cross-sectional view from time point ($t_1$) (FIG. 4A) via time points ($t_2$) (FIG. 4B) and ($t_3$) (FIG. 4C) to time point ($t_4$) (FIG. 4D), and a substantially dense shaped article is formed.
Figure 4B:
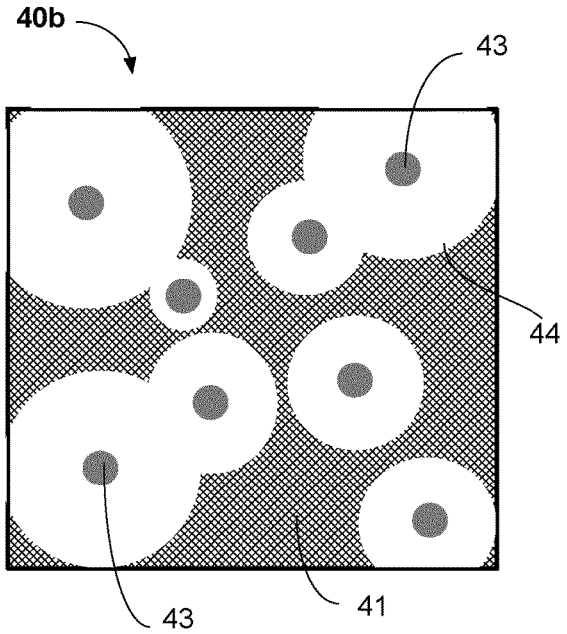
Figure 4C:
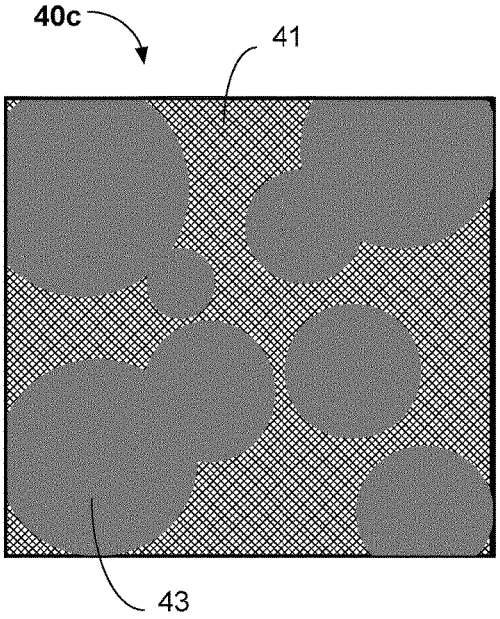
Figure 4D:
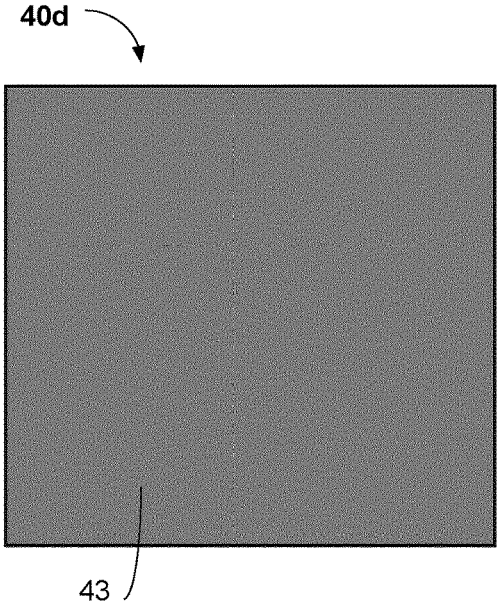

As illustrated in FIGS. 4A, 4B, 4C and 4D, sketches 40*a*, 40*b*, 40*c* and 40*d* show that an SHS reaction can then proceed within a preform from time point ($t_1$) (FIG. 4A) via time points ($t_2$) (FIG. 4B) and ($t_3$) (FIG. 4C) to time point ($t_4$) (FIG. 4D). FIG. 4A shows multiple random reaction initiation sites 42 within a cross-section of preform 41 at which the reactants present in preform 41 initially react at a time point ($t_1$). Initial quantities of SHS reaction product 43 are then formed at these reaction initiation sites 42 within preform 41, while the reaction propagates volumetrically via propagation wave 44 through preform 41 at time point ($t_2$) (FIG. 4B). More of the reactants are converted and SHS reaction product 43 is formed behind propagation wave 44 as the reaction proceeds through preform 41 at time point ($t_3$) (FIG. 4C) until the reactants are fully converted to SHS reaction product 43 and the reaction is complete at time point ($t_4$) (FIG. 4D). The formed product metallic compound, being the SHS reaction product of the first and second reactants initially is more or less porous, and the temperature of the SHS product can initially be substantially higher than the activation temperature $T_a$ as the SHS reaction produces energy in the form of heat. Peak temperatures can exceed the activation temperature $T_a$ by, for example, about 50° C., about 100° C., about 200° C., about 300° C., about 400° C., about 500° C., about 750° C., about 1,000° C., or about 1,500° C.

Figure 8:
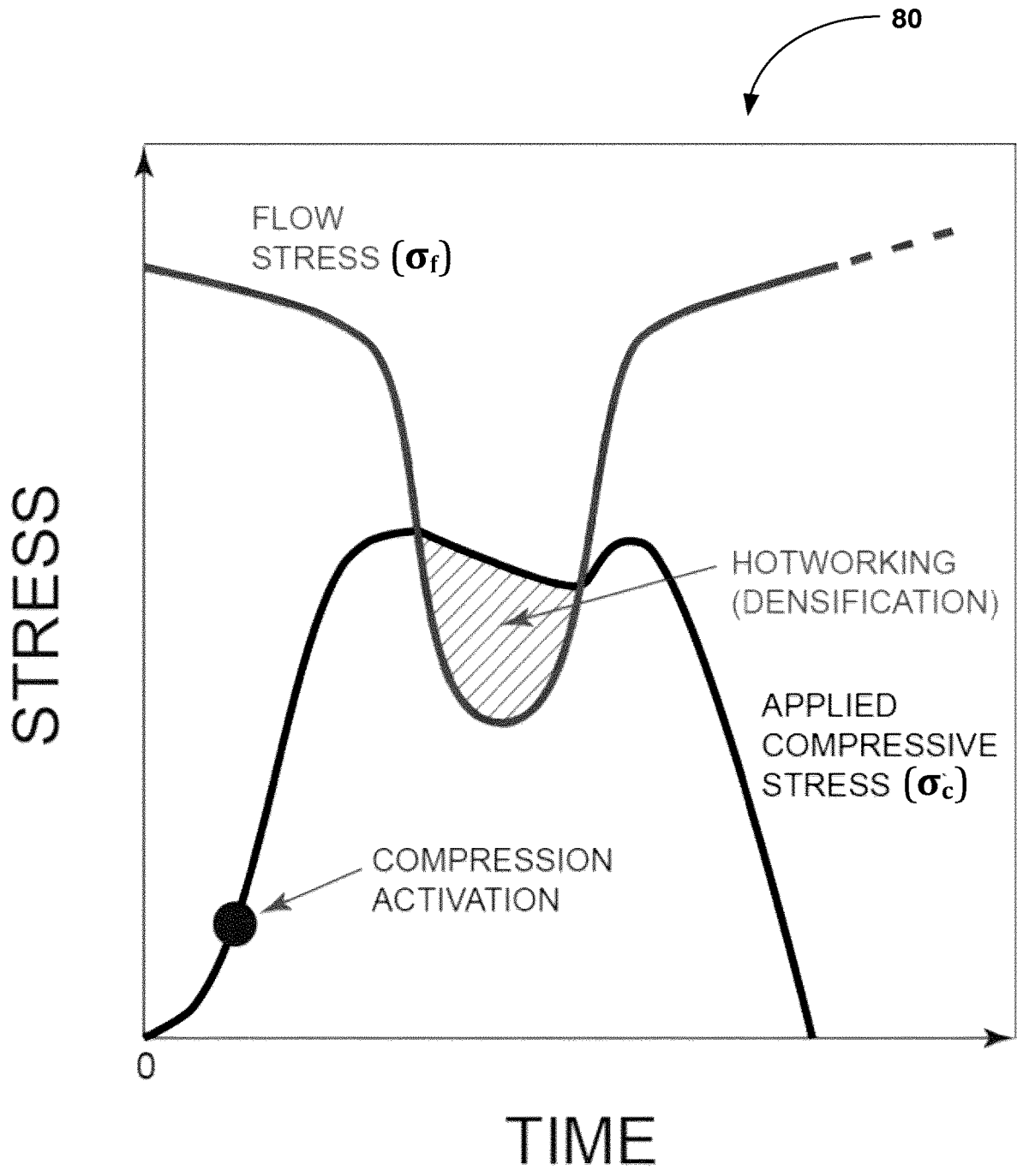
FIG. 8 is a graph illustrating, in general, the compressive stress exerted on the preform article and the flow stress of the product metallic compound as a function of time, showing the relationship between compressive stress, flow stress and time during an SHS reaction.

Next, at approximately peak temperature, for example, at a temperature not less than about 10° C., about 20° C., about 30° C., about 40° C., about 50° C. or about 100° C. below peak temperature, further compressive stress $\sigma_c$ can be exerted on the initially formed more or less porous product metallic compound for a further period of time. In some embodiments, the magnitude of the initially exerted compressive stress $\sigma_c$ can be maintained constant or approximately constant during a further period of time. In some embodiments, the magnitude of compressive stress $\sigma_c$ can be adjusted, and can for example, be increased from the initially exerted compressive stress during a further period of time. Peak temperatures can also exceed the flow stress temperatures $T_f$ defined by flow stress curve 61 (see: FIG. 6). At temperatures above flow stress temperatures $T_f$ 62, flow stress $\sigma_f$ of a product metallic compound can be exceeded upon the application of compressive stress $\sigma_c$, and the product metallic compound can be hot worked. This is further illustrated in FIG. 8, with respect to an example reaction. As can be seen in graph 80, as compressive stress $\sigma_c$ is applied to reactants to initiate an SHS reaction, and as compressive stress $\sigma_c$ increases while the reaction proceeds, the flow stress $\sigma_f$ of the formed porous product can for a period of time be exceeded. During this time period the formed product can be hot worked. Thus, the exerted compressive stress $\sigma_c$ at approximately peak temperature and above flow stress temperature $T_f$ can exceed the flow stress $\sigma_f$ of the formed porous product metallic compound. Under the exerted compressive stress $\sigma_c$ this can result in volumetric reduction of the product and a diminishing of the porosity of the product metallic compound.

Compressive stress $\sigma_c$ can be exerted on the heated preform using any suitable compression device. Thus, for example, in some embodiments a hydraulic press or mechanical press can be used. Compression devices can be used that are designed in such a manner that a preform can be situated between a moveable portion of a compression device, and a static portion sufficiently strong to withstand the compressive stress applied to the preform. Thus, for example, in some embodiments, a compression device comprising a platen can be used. In some embodiments, a compression device comprising a tool, for example, a steel tool, comprising a substantially enclosed solid body having a cavity capable of containing the preform, such as a die, in which the heated preform can be compressed, can be used. The tool, e.g., a die, can be heated, but generally tool temperatures can be maintained below the $T_a$. In some embodiments, it can be beneficial to apply a coating to a tool, such as mineral oil, and sometimes in combination with the dispersion in the mineral oil of solid particles that do not participate in the SHS reaction such as graphite or silicon carbide, in order to limit possible reaction between the tool and reactant or product metallic compounds.

Figure 7A:
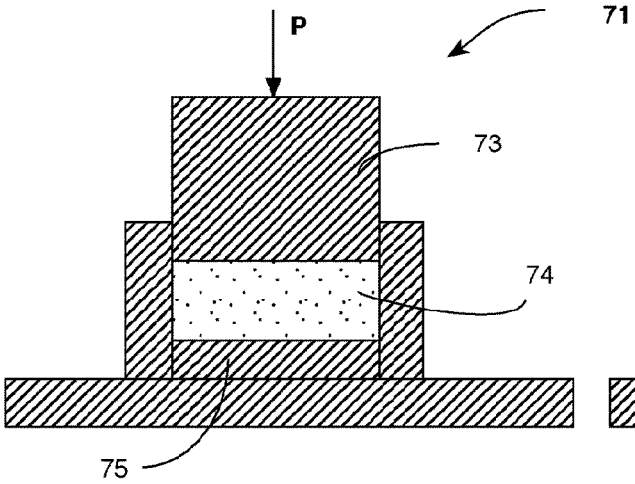
FIGS. 7A, 7B, 7C and 7D are schematic cross-sectional views of a first example device (FIGS. 7A and 7B) and second example device (FIGS. 7C and 7D) that can be used to exert compressive stress on a preform.
Figure 7B:
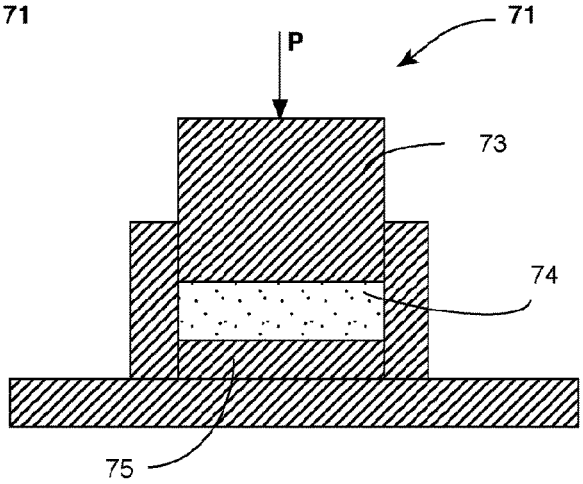
Figure 7C:
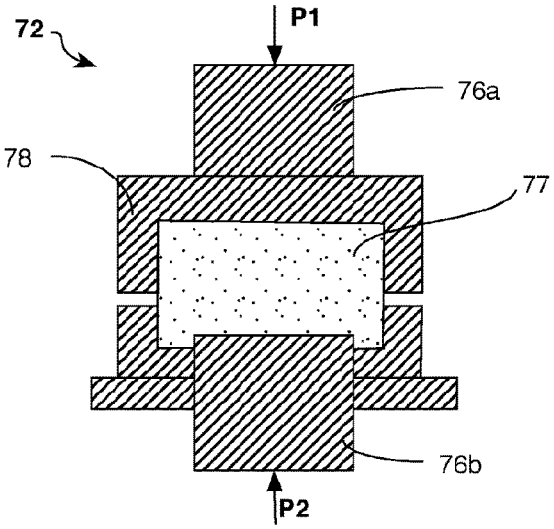
Figure 7D:
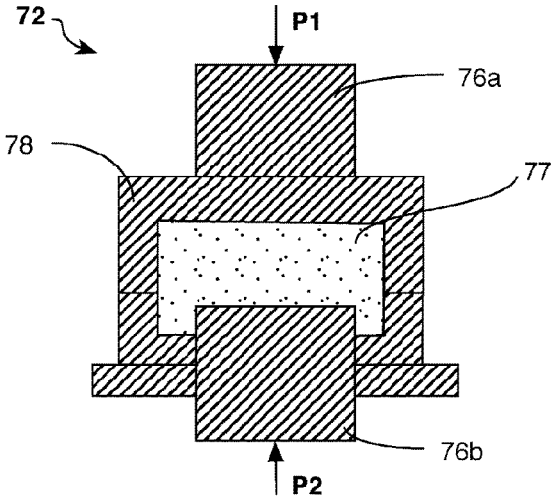

In some embodiments, a piston die combination can be used to exert compressive stress $\sigma_c$, for example, a single piston die combination or a double piston die combination. FIGS. 7A, 7B, 7C and 7D shows example piston die combinations that can be used in accordance with the present disclosure. As shown in FIGS. 7A, 7B, 7C and 7D, in some embodiments, a compression device 71 comprising a single piston-die can be used. Compression device 71 comprises a die 75 and a piston 73. By exerting pressure P on piston 73, a compressive stress is exerted on preform 74 and non-compressed preform 74 (FIG. 7A) is compressed (FIG. 7B). As shown in FIGS. 7C and 7D, in some embodiments, a compression device 72 comprising a double piston-die can be used. Compression device 72 comprises a die 78 and a first piston 76*a* and a second piston 76*b*. By exerting pressure P1 and P2 on pistons 76*a* and 76*b*, respectively, a compressive stress is exerted on preform 77 and non-compressed preform 77 (FIG. 7C) is compressed (FIG. 7D).

The exerted compressive stress ac can vary in magnitude and can be substantial, ranging, for example, from about 10 MPa to about 1,000 MPa, for example, about 50 MPa, about 100 MPa, about 250 MPa, about 500 MPa, or about 1,000 MPa. Furthermore, as noted above, in some embodiments the exerted compressive stress $\sigma_c$ can be maintained constant or approximately constant for a period starting when, or approximately when, $T_a$ is achieved and ending when, or approximately when, a substantially dense product metallic compound has been formed. In other embodiments, the pressure can be adjusted and can, starting when, or approximately when, $T_a$ is achieved, for example, be increased. Increases in compressive stresses ac can be substantial, for example, pressure increases can be such that peak compressive forces exceed the pressure exerted at $T_a$, by, for example, at least about 10 MPa, at least about 50 MPa, at least about 100 MPa, or at least about 200 MPa. These compressive forces ac can at peak pressure be maintained until a substantially dense product metallic compound has been formed. Increases in compressive stresses $\sigma_c$ can be effected so that the compressive stress increases $\sigma_c$ linearly, or approximately linearly, or alternatively non-linearly.

The duration of the period to exert compressive stress $\sigma_c$ can vary. In general, the duration of the period can be deemed to be sufficiently long when for the duration of a first period compressive stress $\sigma_c$ is applied the SHS reaction can be initiated and completed to form an initial porous product, and then for the duration of a second period, the flow stress thereof can be overcome, and a substantially dense article can be formed. For example, starting from initiation of the SHS reaction until the formation of an initial porous product, the duration of the period to exert compressive stress ($\sigma_c$) can be, for example, be about 1 second or less, about 2 seconds or less, about 3 seconds or less, about 4 seconds or less, about 5 seconds or less, or about 10 seconds or less. And, for example, starting from the formation of an initial porous product to the formation of a substantially dense product metallic compound can be at least about 1 second, at least about 2 seconds, at least about 3 seconds, at least about 4 seconds, at least about 5 seconds, at least about 10 second, at least about 20 seconds, at least about 30 seconds, or at least about 1 minute. Thus, as will be clear, the duration of the period to exert compressive stress ac can vary, for example, from 1 second or about 1 second, or from 2 seconds, or about 2 seconds to 10 seconds, or about 10 seconds, from 10 seconds or about 10 seconds to 20 seconds or about 20 seconds, from 20 seconds or about 20 seconds to 30 seconds or about 30 seconds, from 30 seconds or about 30 seconds to a minute or about 1 minute, or from 1 second or about 1 second to 1 minute or about 1 minute.

Thus, to briefly recap, sufficient compressive stress ac is exerted on the preform for a sufficiently long period of time, first to initiate an SHS reaction between first and second reactants and in the SHS reaction initially form a porous product metallic compound, being the SHS reaction product, and then, at approximately peak temperature, to exceed the flow stress of the porous product metallic compound formed in the SHS reaction to thereby substantially reduce the porosity of the product metallic compound and form a substantially dense shaped article. The article now formed is a substantially dense shaped article comprising the product metallic compound. Upon release of compressive stress $\sigma_c$, the article can be cooled and the metallic reaction product can solidify, so that a solid substantially dense shaped article can be obtained.

The solid substantially dense shaped articles that can be fabricated in accordance with methods disclosed herein can be characterized by having a very low porosity, notably a porosity of about 2% or less for example, about 1.9% or less, about 1.8% or less, about 1.7% or less, about 1.6% or less, about 1.5% or less, about 1.4% or less, about 1.3% or less, about 1.2% or less, about 1.1% or less, about 1.0% or less, about 0.9% or less, about 0.8% or less, about 0.7% or less, about 0.6% or less, or about 0.5% or less. The solid substantially dense shaped articles that can be obtained in accordance with methods disclosed herein can be used for any desired purpose.

The solid substantially dense shaped articles that can be fabricated in accordance with methods disclosed herein can further be characterized by being substantially homogenous, and comprising no substantial quantities of unreacted reactants. Thus, the solid substantially dense shaped articles can comprise, for example, less than about 1% (w/w), less than about 0.5% (w/w), less than about 0.1% (w/w), less than 0.01% (w/w) or less than 0.001% (w/w) of unreacted reactant metallic compounds.

Without wishing to be bound by theory, it is believed that the methods of the present disclosure can at an atomic level be facilitated by an increase in atomic collision frequency between the reactants (provided as either solid-solid or liquid-solid reactants), as a result of the exerted compressive stress $\sigma_c$, giving a general description of the reaction rate constant for the reactions conducted in accordance with the methods of the present disclosure as:

$$k=Z(T,\sigma_c)\cdot P(T),$$

wherein "k" is the rate constant, "Z" is the atomic collision frequency and "P" is the probability that a reaction will occur.

It will be clear from the foregoing that the methods of the present disclosure can be conducted by providing particulates comprising a wide variety of combinations of reactants, and the methods can also yield a wide variety of product metallic compounds. The following chemical reactions are provided by way of example only, each reaction representing a different embodiment hereof. It will be understood by those of skill in the art that using the methods of the present disclosure, starting with particulates comprising the reactants set out in these chemical reactions, substantially dense articles constituted by the product metallic compounds set out in these chemical reactions can be manufactured. These example reactions are intended to be illustrative and in no way limiting. It can be understood by those of skill in the art that the methods described herein can be conducted to make dense articles constituted of a wide variety of other metallic compounds, using a wide variety of other reactants.

Implementation of Specific Example Chemical Reactions

Example embodiments using two metallic element reactants:

$$Ni+Al \longrightarrow NiAl-\Delta H;\ \text{or}$$

$$Mg+Ag \longrightarrow MgAg-\Delta H.$$

An example embodiment using a metallic and a non-metallic reactant:

$$5Ti+3Si \longrightarrow Ti_5Si_3-\Delta H$$

Example embodiments forming a product metallic matrix composite comprising a mechanically blended reinforcement, where C(dia) means carbon in the form of diamond, and C(cnt) means carbon in the form of carbon nanotubes:

$$Al+Ni+xC(dia) \longrightarrow NiAl+xC(dia)-\Delta H;\ \text{or}$$

$$Al+3Ti+xC(cnt) \longrightarrow Ti_3Al+xC(cnt)-\Delta H.$$

Example embodiments forming a product metallic matrix composite comprising an in situ formed reinforcement:

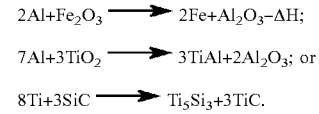

$$2Al+Fe_2O_3 \longrightarrow 2Fe+Al_2O_3-\Delta H;$$

$$7Al+3TiO_2 \longrightarrow 3TiAl+2Al_2O_3;\text{ or}$$

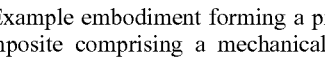

$$8Ti+3SiC \longrightarrow Ti_5Si_3+3TiC.$$

Example embodiment forming a product metallic matrix composite comprising a mechanically blended reinforcement and an in situ formed reinforcement:

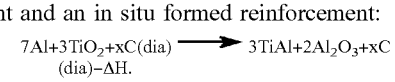

$$7Al+3TiO_2+xC(dia) \longrightarrow 3TiAl+2Al_2O_3+xC(dia)-\Delta H.$$

As now can be appreciated, the methods described herein can be used to manufacture substantially dense shaped articles in a manner that uses conventional tools, such as steel tools, that can be operated within a range of temperatures that limits the need for frequent tool replacement. The methods can be applied to make various product metallic compounds and metallic matrix composites.

Of course, the above described example embodiments of the present application are intended to be illustrative only and in no way limiting. The described embodiments are susceptible to many modifications of form, arrangement of parts, details and order of operation. The disclosure, rather, is intended to encompass all such modifications within its scope, as defined by the claims, which should be given a broad interpretation consistent with the description as a whole.

The above disclosure generally describes various aspects of methods and compositions of the present disclosure. A more complete understanding can be obtained by reference to the following specific examples. These examples are described solely for the purpose of illustration and are not intended to limit the scope of the disclosure. Changes in form and substitution of equivalents are contemplated as circumstances might suggest or render expedient. Although specific terms have been employed herein, such terms are intended in a descriptive sense and not for purposes of limitation.

EXAMPLES

Example 1

Manufacture of a Substantially Dense Metallic Matrix Composite Comprising Titanium Aluminide Reinforced by Aluminum Oxide An experiment was conducted with the objective of producing a titanium aluminide matrix composite comprising a titanium aluminide matrix and an in situ formed aluminum oxide phase, with the titanium aluminide matrix comprising substantially the TiAl phase. The formulation of reactants needed to achieve the desired composition was determined using:

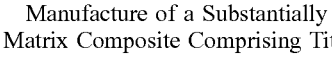

$$7Al+3TiO_2 \rightarrow 3TiAl+2Al_2O_3.$$

According to this equation, the titanium aluminide matrix resulting from this formulation and produced by the reaction is estimated to contain a total atomic percent of aluminum of 50%.

Accordingly, 440.8 grams of aluminum powder with a mean size of 45 micrometers was blended with 559.2 grams of titanium dioxide powder (98% rutile) with a mean particle size of 0.35 micrometers, in a 5 liter jar mill containing 750 milliliters of acetone and 500 grams aluminum oxide balls (also known as milling media) of 1 centimeter in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150 degrees centigrade. After drying, the mixture was passed through a course sieve to remove the milling media, and then passed through a sieve with a screen size of −325 mesh in order to breakup any agglomerates and stored in a sealed container.

To make the preform, 80 grams of the powder mixture was placed in a cylindrical compacting tool with a diameter of 50.8 millimeters, and subjected to an applied stress in the direction of the cylinder axis of 28 megapascals for a time of 3 minutes. The preform was then removed from the compacting tool and placed in a tunnel furnace with an argon atmosphere at 710 degrees centigrade for 1 hour. The preform was then removed from the tunnel furnace and placed in a vertical hydraulic press inside a steel tool heated to 710 degrees centigrade, with the axis of the preform cylinder parallel to the axis of the press. A stress of 90 megapascals was then applied to the heated tool and preform for a period of 6 seconds, during which time the reaction was activated and the reactant product (the titanium aluminide matrix composite) was further compacted to form a titanium aluminide matrix composite disc.

Immediately following compaction, the tool was opened and the disc was removed, covered with aluminum silicate fiber insulation, and allowed to cool to room temperature. The density of the titanium aluminide matrix composite was measured and found to be 3.90 gram per cubic centimeter, with porosity of 1.34% when compared to the theoretical density of 3.953 grams per cubic centimeter for the composite.

Example 2

Manufacture of a Substantially Dense Metallic Matrix Composite Comprising Titanium Aluminide Reinforced by Aluminum Oxide An experiment was conducted with the objective of producing a titanium aluminide matrix composite comprising a titanium aluminide alloy and an in situ formed aluminum oxide phase, with the titanium aluminide alloy comprising a TiAl phase and a $Ti_3Al$ phase, wherein the atomic percentage of aluminum in the alloy is 46.5%. The formulation of reactant materials needed to achieve the desired composition was determined using:

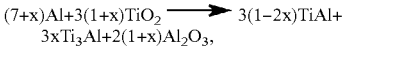

$$(7+x)Al+3(1+x)TiO_2 \longrightarrow 3(1-2x)TiAl+3xTi_3Al+2(1+x)Al_2O_3,$$

where x equals 0.07, which yields:

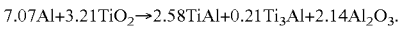

$$7.07Al+3.21TiO_2 \rightarrow 2.58TiAl+0.21Ti_3Al+2.14Al_2O_3.$$

According to this equation, the titanium aluminide alloy matrix resulting from this formulation and produced by the reaction is estimated to contain a total atomic percent of aluminum of 46.5%, and 15.65% $Ti_3Al$ phase by weight.

Accordingly, 426.6 grams of aluminum powder with a mean size of 6 micrometers was blended with 573.4 grams of titanium dioxide powder (98% rutile) with a mean particle size of 0.35 micrometers, in a 5 liter jar mill containing 750 milliliters of acetone and 500 grams aluminum oxide balls (also known as milling media) of 1 centimeter in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150 degrees centigrade. After drying, the mixture was passed through a course sieve to remove the milling media, and then passed through a sieve with a screen size of −325 mesh in order to breakup any agglomerates and stored in a sealed container.

To make the preform, 60 grams of the powder mixture was placed in a cylindrical compacting tool with a diameter of 50.8 millimeters, and subjected to an applied stress in the direction of the cylinder axis of 28 megapascals for a time of 3 minutes. The preform was then removed from the compacting tool and placed in a tunnel furnace with an argon atmosphere at 720 degrees centigrade for 1 hour. The preform was then removed from the tunnel furnace and placed in a vertical hydraulic press inside a steel tool heated to 720 degrees centigrade, with the axis of the preform cylinder parallel to the axis of the press. A stress of 90 megapascals was then applied to the heated tool and preform for a period of 6 seconds, during which time the reaction was activated and the reactant product (the titanium aluminide matrix composite) was further compacted to form a titanium aluminide alloy matrix composite disc.

Immediately following compaction, the tool was opened and the disc was removed, covered with aluminum silicate fiber insulation, and allowed to cool to room temperature. Notably, the disc was intact upon removal, and remained intact while cooling to room temperature. The density of the titanium aluminide alloy matrix composite was measured and found to be 3.948 gram per cubic centimeter, with porosity of 0.69% when compared to the theoretical density of 3.975 grams per cubic centimeter for the composite.

Example 3

Manufacture of a Substantially Dense Metallic Compound Comprising Nickel Aluminide An experiment was conducted with the objective of producing a nickel aluminide compound comprising substantially the NiAl phase. The formulation of reactants needed to achieve the desired composition was determined using:

$$Al+Ni \rightarrow NiAl.$$

According to this equation, the nickel aluminide compound resulting from this formulation and produced by the reaction is estimated to contain a total atomic percent of aluminum of 50%.

Accordingly, 314.9 grams of aluminum powder with a mean size of 45 micrometers was blended with 685.1 grams of nickel powder with a mean particle size of 0.8 micrometers, in a 5 liter jar mill containing 750 milliliters of acetone and 500 grams aluminum oxide balls (also known as milling media) of 1 centimeter in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150 degrees centigrade. After drying, the mixture was passed through a course sieve to remove the milling media, and then passed through a sieve with a screen size of −325 mesh in order to breakup any agglomerates and stored in a sealed container.

To make the preform, 75 grams of the powder mixture was placed in a cylindrical compacting tool with a diameter of 50.8 millimeters, and subjected to an applied stress in the direction of the cylinder axis of 28 megapascals for a time of 3 minutes. The preform was then removed from the compacting tool and placed in a tunnel furnace with an argon atmosphere at 750 degrees centigrade for 10 minutes. The preform was then removed from the tunnel furnace and placed in a vertical hydraulic press inside a steel tool heated to 590 degrees centigrade, with the axis of the preform cylinder parallel to the axis of the press. A stress of 90 megapascals was then applied to the heated tool and preform for a period of 6 seconds, during which time the reaction was activated and the reactant product (the nickel aluminide compound) was further compacted.

Immediately following compaction, the tool was opened and the disc was removed, covered with aluminum silicate fiber insulation, and allowed to cool to room temperature. The density of the nickel aluminide compound was measured and found to be 5.75 gram per cubic centimeter, with porosity of 1.87% when compared to the known density of 5.86 grams per cubic centimeter for the compound.

Example 4

Manufacture of a Substantially Dense Metallic Matrix Composite Comprising Titanium Silicide Reinforced by Titanium Carbide An experiment was conducted with the objective of producing a titanium silicide matrix composite comprising a titanium silicide matrix and an in situ formed titanium carbide phase, with the titanium silicide matrix comprising substantially the $Ti_5Si_3$ phase. The formulation of reactants needed to achieve the desired composition was determined using:

$$8Ti+3SiC \rightarrow Ti_5Si_3+3TiC.$$

According to this equation, the titanium silicide matrix resulting from this formulation and produced by the reaction is estimated to contain a total atomic percent of silicon of 37.5%.

Accordingly, 761 grams of titanium powder with a mean size of 45 micrometers was blended with 239 grams of silicon carbide powder with a mean particle size of 0.065 micrometers, in a 5 liter jar mill containing 750 milliliters of acetone and 500 grams aluminum oxide balls (also known as milling media) of 1 centimeter in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150 degrees centigrade. After drying, the mixture was passed through a course sieve to remove the milling media, and then passed through a sieve with a screen size of −325 mesh in order to breakup any agglomerates and stored in a sealed container.

To make the preform, 50 grams of the powder mixture was placed in a cylindrical compacting tool with a diameter of 50.8 millimeters, and subjected to an applied stress in the direction of the cylinder axis of 28 megapascals for a time of 3 minutes. The preform was then removed from the compacting tool and placed in a tunnel furnace with an argon atmosphere at 1,000 degrees centigrade for 12 minutes. The preform was then removed from the tunnel furnace and placed in a vertical hydraulic press inside a steel tool heated to 880 degrees centigrade, with the axis of the preform cylinder parallel to the axis of the press. A stress of 90 megapascals was then applied to the heated tool and preform for a period of 6 seconds, during which time the reaction was activated and the reactant product (the titanium silicide matrix composite) was further compacted to form a titanium silicide matrix composite disc.

Immediately following compaction, the tool was opened and the disc was removed, covered with aluminum silicate fiber insulation, and allowed to cool to room temperature. The density of the titanium silicide matrix composite was measured and found to be 4.43 gram per cubic centimeter, with porosity of 1.12% when compared to the theoretical density of 4.48 grams per cubic centimeter for the composite.

Example 5

Manufacture of a Substantially Dense Metallic Compound Comprising Magnesium Ardentide An experiment was conducted with the objective of producing a magnesium argentide compound comprising substantially the MgAg phase. The formulation of reactants needed to achieve the desired composition was determined using:

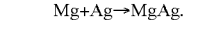

$$Mg+Ag \rightarrow MgAg.$$

According to this equation, the magnesium argentide compound resulting from this formulation and produced by the reaction is estimated to contain a total atomic percent of silver of 50%.

Accordingly, 183.9 grams of magnesium powder with a mean size of 25 micrometers was blended with 816.1 grams of silver powder with a mean particle size of 0.04 micrometers, in a 5 liter jar mill containing 750 milliliters of acetone and 500 grams aluminum oxide balls (also known as milling media) of 1 centimeter in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150 degrees centigrade. After drying, the mixture was passed through a course sieve to remove the milling media, and then passed through a sieve with a screen size of −325 mesh in order to breakup any agglomerates and stored in a sealed container.

To make the preform, 35 grams of the powder mixture was placed in a cylindrical compacting tool with a diameter of 50.8 millimeters, and subjected to an applied stress in the direction of the cylinder axis of 28 megapascals for a time of 3 minutes. The preform was then removed from the compacting tool and placed in a tunnel furnace with an argon atmosphere at 1,000 degrees centigrade for 10 minutes. The preform was then removed from the tunnel furnace and placed in a vertical hydraulic press inside a steel tool heated to 800 degrees centigrade, with the axis of the preform cylinder parallel to the axis of the press. A stress of 90 megapascals was then applied to the heated tool and preform for a period of 6 seconds, during which time the reaction was activated and the reactant product (the nickel aluminide compound) was further compacted.

Immediately following compaction, the tool was opened and the disc was removed, covered with aluminum silicate fiber insulation, and allowed to cool to room temperature. The density of the magnesium argentide compound was measured and found to be 4.5 gram per cubic centimeter. The amount of porosity was unknown since the density of pure MgAg is unknown.

While the above description provides examples of one or more apparatuses, methods and/or compositions, it will be appreciated that the scope of the claims should not be limited by the preferred embodiments set forth in the examples, but should be given the broadest interpretation consistent with the description as a whole.

We claim:

1. A method of manufacturing an article, the method comprising:

providing a first particulate comprising a first reactant;

providing a second particulate comprising a second reactant, wherein the second reactant is different than the first reactant;

blending the first and second particulates to form a particulate blend;

preforming the particulate blend to form a preform article;

heating the preform article to a pre-heat temperature, wherein the pre-heat temperature is below an auto-activation temperature and above a minimum compression activated synthesis temperature; and while maintaining the preform article at the pre-heat temperature, commencing exerting compressive stress on the preform article to:

(i) initiate a self-propagating high-temperature synthesis reaction between the first and second reactants by the compressive stress and thereby form a product metallic compound, and (ii) at approximately peak temperature, exceed a flow stress of the product metallic compound to reduce porosity of the product metallic compound and thereby form the article, wherein the first reactant comprises a first metal, the first metal is selected from the group consisting of Ag, Al, Fe, Mg, Ni, Ti, and combinations thereof, and the first reactant is metallic or is a metal compound, and wherein the second reactant comprises a second metal, the second metal is selected from the group consisting of Ag, Al, Fe, Mg, Ni, Ti, and combinations thereof, and the second reactant is metallic or is a metal compound.

2. The method of claim 1, wherein:

at the pre-heat temperature, the first and second reactants are extant in solid form;

prior to the step of blending, the first particulate has a mean particle size of between about 1 μm and about 100 μm;

prior to the step of blending, the second particulate has a mean particle size of between about 0.1 μm and about 3 μm; and prior to the step of blending, the mean particle size of the first particulate is at least three times the mean particle size of the second particulate.

3. The method of claim 1 wherein the first particulate comprises at least 95% (w/w) of the first reactant, and the second particulate comprises at least 95% (w/w) of the second reactant.

4. The method of claim 1, wherein the self-propagating high-temperature synthesis reaction is characterized by a $\Delta H<0$ and a $\Delta G<0$.

5. The method of claim 1, wherein, after the step of preforming, the preform article has a near net shape.

6. The method of claim 1, wherein at least one of the first and second reactants comprise two or more bonded metallic elements.

7. The method of claim 1, wherein at least one of the first and second reactants comprise a metallic element bonded to a non-metallic element.

8. The method of claim 1, wherein the second reactant comprises a non-metallic element.

9. The method of claim 1, wherein the second reactant is selected from the group consisting of a metal-boride, a metal-carbide, a metal-nitride, and a metal-oxide.

10. The method of claim 1, wherein the product metallic compound comprises two chemically bonded metallic elements.

11. The method of claim 1, wherein the product metallic compound comprises a metallic matrix composite.

12. The method of claim 1, wherein the first reactant is Al, the second reactant is $TiO_2$, and the product metallic compound comprises a metallic matrix composite comprising TiAl and $Al_2O_3$.

13. The method of claim 1, wherein the compressive stress is between about 50 MPa and about 100 MPa.

14. The method of claim 1, wherein the heating step comprises placing the preform article in a furnace, heating the preform article in the furnace to reach the pre-heat temperature, and removing the preform article from the furnace.

15. The method of claim 1, wherein the step of exerting comprises maintaining the compressive stress approximately constant for a period starting approximately when the auto-activation temperature is achieved and ending approximately when the article has been formed.

16. The method of claim 1, wherein the step of exerting comprises increasing the compressive stress during a period starting approximately when the auto-activation temperature is achieved and ending approximately when the article has been formed.

17. The method of claim 14, wherein the exerting step comprises placing the preform article in a compression device while at the pre-heat temperature, and using the compression device to apply the compressive stress on the preform article to initiate the reaction.

18. The method of claim 16, wherein the period lasts from about 1 second to about 1 minute.

19. A method of manufacturing an article, the method comprising:

(a) providing a first particulate comprising a first reactant;
  (i) wherein the first reactant comprises a first metal;
  (ii) wherein the first metal is selected from the group consisting of Ag, Al, Fe, Mg, Ni, Ti, and combinations thereof;
  (iii) wherein the first reactant is metallic or is a metal compound;

(b) providing a second particulate comprising a second reactant;
  (i) wherein the second reactant comprises a second metal;
  (ii) wherein the second metal is different than the first metal;
  (iii) wherein the second metal is selected from the group consisting of Ag, Al, Fe, Mg, Ni, Ti, and combinations thereof;
  (iv) wherein the second reactant is metallic or is a metal compound;

(c) blending the first and second particulates to form a particulate blend;

(d) preforming the particulate blend to form a preform article;

(e) heating the preform article to a pre-heat temperature, wherein the pre-heat temperature is below an auto-activation temperature and above a minimum compression activated synthesis temperature; and (f) while maintaining the preform article at the pre-heat temperature, commencing exerting compressive stress on the preform article to:
  (i) initiate a self-propagating high-temperature synthesis reaction between the first and second reactants by the compressive stress and thereby form a product metallic compound, and
  (ii) at approximately peak temperature, exceed a flow stress of the product metallic compound to reduce porosity of the product metallic compound and thereby form the article;

wherein the article comprises a porosity of less than 1.9%.

20. The method of claim 19, wherein the article comprises a porosity of less than 1.5%.

* * * * *